US008509657B2

(12) United States Patent
Takeshita

(10) Patent No.: US 8,509,657 B2
(45) Date of Patent: Aug. 13, 2013

(54) TWO COMPONENT DEVELOPER STORAGE PRODUCT AND METHOD OF FILLING TWO COMPONENT DEVELOPER

(75) Inventor: Haruo Takeshita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 202 days.

(21) Appl. No.: 13/190,234

(22) Filed: Jul. 25, 2011

(65) Prior Publication Data

US 2012/0039634 A1 Feb. 16, 2012

(30) Foreign Application Priority Data

Aug. 11, 2010 (JP) ..... 2010-180065

(51) Int. Cl.
*G03G 15/08* (2006.01)

(52) U.S. Cl.
USPC ..... 399/259; 399/262

(58) Field of Classification Search
USPC ..... 399/258–259, 262
See application file for complete search history.

(56) References Cited

U.S. PATENT DOCUMENTS

| | | | | |
|---|---|---|---|---|
| 6,330,411 | B1 * | 12/2001 | Suzuki | 399/120 |
| 7,962,070 | B2 * | 6/2011 | Takeshita et al. | 399/258 |
| 8,086,146 | B2 * | 12/2011 | Uno et al. | 399/258 |
| 8,165,508 | B2 * | 4/2012 | Matsumoto et al. | 399/259 |
| 8,180,261 | B2 * | 5/2012 | Muramatsu et al. | 399/258 |

FOREIGN PATENT DOCUMENTS

| | | |
|---|---|---|
| JP | 2004-029306 | 1/2004 |
| JP | 3777778 | 3/2006 |

* cited by examiner

*Primary Examiner* — Clayton E Laballe
*Assistant Examiner* — Leon W Rhodes, Jr.
(74) *Attorney, Agent, or Firm* — Lucas & Mercanti, LLP

(57) ABSTRACT

A two component developer storage product to replenish a two component developer containing at least toner and carrier includes: a cylindrical container having an opening at one end thereof; a lid to close the opening; a toner layer stored in the cylindrical container; and a carrier layer stored in the cylindrical container; wherein the toner layer and the carrier layer are stacked, and the cylindrical container has a spiral projection on an inner spherical surface thereof, and is configured such that when the cylindrical container is rotated, the toner layer and the carrier layer are conveyed by the spiral projection and toner and carrier are discharged from the opening.

6 Claims, 8 Drawing Sheets

B14
30A
B10
30B
DC DT DC
DC
B10
DC
DT
DC

30D
B14
30A
30C
30E
30B
30I
30G
30F
30K
B10
30J
DT
DC
B10
DC
DT
DC

B14
30
B10
DT DC
B10
DC
DT

TWO COMPONENT DEVELOPER STORAGE PRODUCT AND METHOD OF FILLING TWO COMPONENT DEVELOPER

This application is based on Japanese Patent Application No. 2010-180065 filed on Aug. 11, 2010, in Japanese Patent Office, the entire content of which is hereby incorporated by reference.

BACKGROUND OF THE INVENTION

The present invention relates to a two component developer storage product for replenishing a two component developer which includes at least toner and carrier and is used for an image forming apparatus of an electro-photographing type, and a method of filling a two component developer in a developer storage container.

In the field of an image forming technique with an electrophotographing system, it becomes possible to form a microscopic image with an image writing density of a 1200 dpi level (dpi; the number of dots per 1 inch (2.54 cm)) with progress of a digital processing technique, a semiconductor laser exposure technique, and the like. Further, the realization of such microscopic image formation makes it possible to spread the electro-photographic image to a market where a precise image with high image resolution is required.

Specific examples of the market include the print market called "on-demand printing", and the electro-photographing system allows prints to be produced continuously in a short time without preparing a printing plate which is needed essentially in the conventional printing system. In the case where prints are produced continuously at a high rate, image formation of the two component developer type in which toner can be charged promptly by carrier is advantageous.

In image formation of the two component development type, toner is frictionally charged on the surface of carrier stored in an apparatus called a developing device, and the toner charged to a predetermined level is supplied to an image carrying member, whereby an electrostatic latent image on the image carrying member is developed. In the fictional electrification for toner conducted on the surface of carrier in the developing device, if the same carrier is used repeatedly for a long period of time, the charging performance of the carrier gradually lowers. Namely, if the same carrier is used repeatedly, a resin layer provided on the surface of the carrier wears or peels off, and the composition of toner adheres on the surface of the carrier. Accordingly, the charging performance of the carrier gradually lowers. As a result, the carrier cannot conduct required frictional electrification for toner, and in turn, a predetermined amount of toner cannot be supplied onto a photoreceptor, which results in poor development such as lowering in image density.

In order to solve this problem, adopted is a developer replenishing method called an "auto-refining development method" which feeds new carrier simultaneously with feeding of toner consumed by development and replaces the carrier in a developing device little by little, thereby maintaining the electric charge providing performance of the carrier. The "auto-refining development" is also called "trickle development" in which, for example, an additive amount is changed or carrier which is applied with a counter measure such regulation of electric resistance and the like is supplied so as to maintain the electrically charging performance of the developer in a developing device to a predetermined level (for example, refer to Patent documents 1 and 2).

For example, Patent document 1 discloses a technique that the carrier concentration of a replenishment developer is made within a specific range and a difference in electric resistance between the in-use developer in a developing device and new carrier is regulated so as to maintain the performance of the developer stably. Further, Patent document 1 discloses a technique that a plurality of replenishment developers different in electric property is prepared by use of plurality of carriers different in electric resistance value, these developers are stored separately in the same developer container, and carrier different in electric resistance value is fed selectively in accordance with the toner replenishment time so as to maintain the performance of the developer.

In this way, in the "auto-refining development", since new carrier is also fed simultaneously with feeding of toner, in a developing device, carrier always exhibits the electric charge providing performance with a predetermined level so as to make it possible to maintain the imaging quality of produced prints stably over a long period of time.

Patent document 1: U.S. Pat. No. 3,777,778, Official report

Patent document 2: Japanese Unexamined Patent Publication No. 2004-29306, official report As mentioned above, in the auto-refining development, although carrier is also supplied to a developing device together with toner, a replenishment two component developer stored in a developer storage container is kept in many cases in the stationary state all the time until it is supplied to a developing device. However, if toner and carrier are kept stationary for a long period of time in the state that toner is mixed with toner, shift of charge occurs on the contact portions between carrier and toner, which results in that the amount of electric charge of developer tends to become low as compared with the initial stage. Further, toner and carrier are transported in the mixed state, spent toner that toner adheres in fixture contact with the surface of carrier in receipt of the influence of vibration. Accordingly, it is considered to be desirable that toner and carrier of a replenishment two component developer are preserved separately so as to avoid contact between them until the toner and the carrier are mixed at the time of supply to a developing device.

In the case where toner and carrier are preserved separately and are mixed first when being fed to a developing device, toner and carrier are filled and preserved in respective containers separately, and a toner feeding means and a carrier feeding means are needed respectively at the time of provision to a developing device. Further, at the time of provision to a developing device, it is necessary to feed toner and carrier with a predetermined ratio, and a means to measure these accurately is also needed. Accordingly, the installation of these means to an apparatus causes increase of the number of machinery components in an image forming apparatus and makes the structure complicate, which influences cost and maintenance.

From the above reasons, in an image forming apparatus in which a developer is replenished by an auto-refining method, the developer is replenished mainly with a developer in which toner and carrier are mixed preliminary. Therefore, it is unavoidable that an amount of electric charge of a developer decreases due to contact between the toner and carrier for a long period of time and poor image is generated due to spent toner. As a result, a technique is sought to make it possible to preserve toner and carrier so as to be not likely to contact with each other in a container and to mix the toner and the carrier first with an accurate ratio when feeding them to a developing device.

An object of the present invention is to provide a two component developer storage product which forms a state that toner and carrier do not contact easily with each other in a developer storage container and can feed toner and carrier accurately with a predetermined ration when feeding them to a developing device. Specifically, an object of the present invention is to provide a two component developer storage product which avoids the contact between toner and carrier for a long period of time as far as possible by preserving toner and carrier separately in a developer storage container, whereby a electric charging ability can be prevented from lowering due to shift of electric charge between them.

Further, an object of the present invention is to provide a developer feeding method with which an opportunity to allow toner and carrier to contact with each other can be minimize, toner is not made to adhere in fixture contact with the surface of carrier even in receipt of impact during transportation of a developer storage container, and a charge providing performance of carrier can be prevented from lowering due to spent toner. Further, an object of the present invention is to provide a developer feeding method with which stores a toner layer and a carrier layer regularly in a storage container so as to feed toner and carrier with a predetermined ratio.

The above objects can be attained by the following two component developer storage product and two component developer filling method which reflects one aspect of the present invention.

A two component developer storage product to replenish a two component developer containing at least toner and carrier includes:

a cylindrical container having an opening at one end thereof;

a lid to close the opening;

a toner layer stored in the cylindrical container; and a carrier layer stored in the cylindrical container;

wherein the toner layer and the carrier layer are stacked, and the cylindrical container has a spiral projection on an inner spherical surface thereof, and is configured such that when the cylindrical container is rotated, the toner layer and the carrier layer are conveyed by the spiral projection and toner and carrier are discharged from the opening.

A two component developer filling method for filling a two component developer containing at least toner and carrier includes in a developer storage container includes:

filling a toner layer of the toner and a carrier layer of the carrier so as to form a state of stacked layers in the developer storage container.

DETAILED DESCRIPTION OF THE PREFERRED EMBODIMENT

The present invention relates to a two component developer storage product used for an auto-refining development method which maintains an electrically charging performance of developer by supplying new carrier at the same time as the replenishment of toner which is consumed by image formation, and to a developer filling method for filling a replenishment two component developer into a developer storage container.

The present inventor focused attention on the fact that, when a replenishment developer is supplied in a developing device of an image forming apparatus corresponding to an auto-refining development method, sufficient agitation is conducted in the developing device in order to mix the supplied developer and the old developer uniformly. That is, the present inventor noticed that since a replenishment two component developer is uniformly mixed in the developing device, it is not necessary to store the replenishment two component developer in such a way that toner particles and carrier particles are mixed uniformly beforehand and stored on the uniformly-mixed condition in a developer storage container.

Further, the present inventor conceived that if toner and carrier are maintained in the state that the toner and the carrier are separated so as not to contact with each other as far as possible in a developer storage container until the toner and the carrier are supplied to a developing device, the performance of a two component developer composed of toner and carrier can be maintained stably for a long period of time. Then, as a result of diligent studies, the present inventor found a filling technique of a two component developer with which a toner layer and a carrier layer are stored on a stacked state in a developer storage container. A two component developer storage product of the present invention includes a storage section in which a toner layer and a carrier layer, which are filled by the above filling technique, are stored in a stacked state, and a conveying section which discharges toner and carrier with a predetermined ratio from the toner layer and the carrier layer.

Hereafter, the present invention will be explained in detail.

Figure 1:
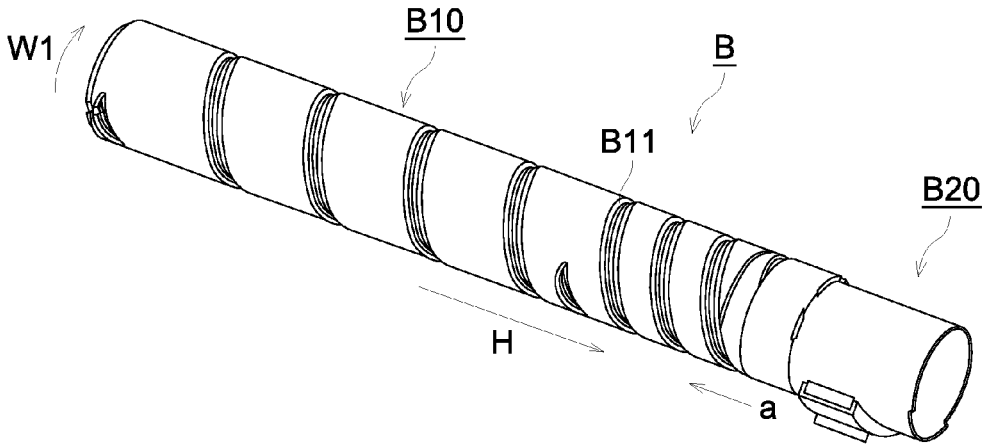
FIG. 1 is a perspective view of an external appearance of a developer storage container capable of storing a replenishment developer.

At the outset, description will be given based on FIG. 1 with regard to a developer storage container which can store a two component developer in the state (the state of stacked layers) that toner and carrier are separated by a method for filling a two component developer according to the present invention. FIG. 1 shows the outer appearance of one embodiment of a developer storage container in which a replenishment developer is stored by a method for filling a two component developer according to the present invention.

A developer storage container B which can store a replenishment developer has a cylindrical container main body B10, and cap B20. The container main body B10 is a cylindrical hollow resin component produced by blow molding or the like and a section, denoted in the present invention, which stores a two component developer the present invention, and a spiral projection B11 is formed in the inner circumference surface of the container main body B10.

The cap B20 is a component which is made of resin and produced by injection molding or the like, and the cap B20 seals the developer stored in the container main body B10 and feeds developer discharged from the container main body B10 to a developing device of an image forming apparatus.

The developer storage container B which is storing a toner layer and a carrier layer in the state of stacked layers is mounted on an image forming apparatus (not shown) and feeds the stored toner and carrier as a two component developer to a developing device of the image forming apparatus. The container main body B10 is rotated with a driving means provided in the image forming apparatus so as to convey the stored developer with the action of rotation, whereby the stored toner and carrier are fed to the developing device. That is, in the developer storage container B shown in FIG. 1, a container main body 10 is rotated in a direction of W1 shown in the drawing by a driving means provided in the image forming apparatus.

With the rotation of the container main body B10 in the W1 direction, the developer stored in the container main body B10 is received a conveyance action from the spiral projection B11 and is conveyed in the direction of an arrow H, i.e., in the direction toward to the cap B20. Successively, the developer is discharged and fed from the discharging port of the cap B20 (not shown) to the developing device of the image forming apparatus. While the container main body B10 is being rotated so as to convey the stored developer in the direction of an arrow H, the cap B20 is made to remain still. In this way, the container main body B10 is rotated so as to convey the developer stored in the developer storage container B, whereby the developer is fed to the developing device. Namely, the developer storage container B which is storing a toner layer and a carrier layer in the state of stacked layers, represents a preferred embodiment of a two component developer storage product of the present invention, and concretely, the container main body B constitutes the storage section of the two component developer storage product of the present invention, and the spiral projection B11 provided on the inner circumference surface of the container main body B constitutes the conveyance section.

Although an engaging mechanism is not illustrated, the cap B20 has an engaging section with which the cap B20 is engaged with the container main body B10, and if the engaging section is moved so as to release the engagement, the container main body B10 is pulled in the direction of an arrow "a" on the released state, the cap B20 can be removed from the container main body B10. Further, the cap B20 is made to come in contact with an opening (not shown) of the container main body 10B, and on this state, the cap B20 is pushed in the direction of an arrow "a", whereby the cap B20 can be engaged with the container main body B10.

In the developer storage container shown in FIG. 1, with the structure the a sealing member is provided to an opening (not shown) of the container main body B10 and a gap between the container main body B10 and the cap B20 is sealed with the sealing member, leakage of the developer stored in the container main body B10 can be prevented securely.

Next, description will be given below with regard to the filling method of the present invention for filling a two component developer into a developer storage container. In the present invention, when a two component developer containing at least a toner and a carrier is filled in a developer storage container, the two component developer is filled such that a toner region (toner layer) and a carrier region (carrier layer) are separated to form the state of stacked layers in the developer storage container.

The present inventor focused attention on the fact that a replenishment developer in a developer storage container is preserved in a still-standing state until it is fed to a developing device, and conceived to prevent charge from shifting at contact portions between carrier and toner as far as possible during preservation until it is fed to a developing device. Then, the present inventor considered to realize the above matter in the state that toner and carrier are stored in one developer storage container, and devised the present invention as a result of diligent studies.

The present inventor found that the preservation of toner and carrier by formation of a stacked layer in one developer storage container minimizes the contact between the toner and the carrier in the container so that reduction of electrically charging properties due to the shift of electric charge between the toner and the carrier can be prevented. In this way, in the preservation state that independent toner and carrier regions, i.e. a toner layer and a carrier layer are formed in a developer storage container, since toner and carrier are not mixed with each other easily, reduction in an amount of electric charge due to contact can be prevented and spent toner can be suppressed.

The present inventor found that if toner and carrier are preserved in the state of stacked layers in a developer storage container, toner and carrier are not mixed easily with each other in the state of stacked layers. This reason is considered to be that since toner particles have a very small particle size of several micron meters as compared with carrier and a developer is stored with a high filling rate in a container, carrier particles and toner particles form the state that carrier particles do not easily come in gaps between toner particles. Further, the state of stacked layers of a toner layer and a carrier layer formed in a developer storage container is not easily broken by an external force with a strength corresponding to an impact caused in the course of transportation, and it is considered that toner and carrier form a state in which toner and carrier do not mix easily with each other. Therefore, it is considered that, even if some impact is applied onto a developer storage container filled with a two component developer, toner and carrier do not mix with each other, adhesion of toner on the surface of carrier is avoided so as to contribute to maintain the quality of the developer stably.

In a toner layer forming the state of stacked layers of the present invention, the toner content in the toner layer is 99% by weight or more per 1 $cm^3$, and also in a carrier layer, the carrier content in the carrier layer is 95% by weight or more per 1 $cm^3$. A toner region and a carrier region which do not correspond to the toner layer and the carrier layer, form a boundary layer.

As a method to check whether the two component developer stored in a developer storage container forms a toner layer and a carrier layer, for example, a method of carrying out X-ray photography for the developer storage container is effective. That is, since the carrier layer which is a magnetic substance is clearly photographed with X-rays, the distribution state of toner and carrier in the developer storage container can be checked.

When a developer in a developer storage container is fed to a developing device, it is necessary to feed toner and carrier with a predetermined ratio to the developing device. In the present invention, it is possible to form a toner layer and a carrier layer in a developer storage container so as to correspond to this predetermined ratio. Examples of methods for forming a toner layer and a carrier layer in the state of stacked layers so as to be able to feed toner and carrier with a predetermined ratio to a developing device, include a method of filling tone and carrier in a state that magnets are arranged, and a method of conducting toner filling and carrier filling alternately.

Description will be given more with regard to the state of stacked layers formed by a toner layer and a carrier layer in a two component developer stored in a developer storage container. For example, as described above, on the condition that the developer storage container B shown in FIG. 1 is mounted on an image forming apparatus, a container main body B10 in which a two component developer is filled up, is rotated so as to convey the stored two component developer by the action of rotation, whereby the two component developer is fed to the developing device. That is, the developer storage container used in the present invention is configured to feed the stored developer to the developing device on the condition that the developer storage container is mounted on the image forming apparatus.

When a developer is filled up in such a developer storage container, it is desirable in the present invention that the developer is filled up such that the stacked state of a toner layer and a carrier layer is formed in parallel to the conveying direction (the axial direction of a cylinder) of the developer caused by the rotation of a container main body on the condition that container main body is mounted on an image forming apparatus. That is, when a two component developer is filled up such that the stacked state of a toner layer and a carrier layer is formed in parallel to the conveying direction of the two component developer caused by the rotation of a container main body on the condition that container main body is mounted on an image forming apparatus, since toner and carrier can be fed always with a predetermined ration to a developing device, it is desirable. Further, the filled-up two component developer maintains the state of stacked layers composed of a toner layer and a carrier layer immediately before being fed to a developing device. Accordingly, since it becomes possible to prevent reduction of an amount of charge of a two component developer and occurrence of spent toner, it is desirable.

Herein, the term "parallel" means that when a developer storage container storing a developer is mounted on an image forming apparatus, the structure of stacked layers of a toner layer and a carrier layer in the container becomes almost parallel to the conveyance direction of the stored developer. Therefore, the term "parallel" includes the case where the structure of stacked layers of a toner layer and a carrier layer is formed obliquely in some degree to the conveyance direction of a two component developer caused on the condition that the developer storage container is mounted on the image forming apparatus. That is, the term "parallel" does not means in a limited way that a toner layer and a carrier layer are respectively parallel in a strict sense to the conveyance direction of a two component developer, that is, a toner layer and a carrier layer are respectively formed at 180 degrees to the conveyance direction of a two component developer caused in a container on the condition the container is mounted on an image forming apparatus.

Further, when a toner layer and a carrier layer are filled up such that a two component developer as a whole is filled in a developer storage container, it is desirable, in the present invention, to fill the toner layer and the carrier layer in such a way that the concentration of carrier in the two component developer as a whole become 5% by weight or more and 30% by weight or less. Namely, when the concentration of carrier is in the above-mentioned range, the condition that the amount of carrier being in contact with toner is suppressed to be relative small is formed in a developer storage container. Therefore, it is considered to be desirable, because deterioration of a developer, such as reduction of an amount of electric charge and occurrence of spent toner does not take place not to influence image formation.

Moreover, the inside of the developing device in which such a two component developer is fed becomes the condition that new carrier and old carrier exist in a mixed state. However, when the concentration of carrier is in the above-mentioned range, even if the new carrier and the old carrier exist in a mixed state, it is considered that a difference in an electric charge providing performance between the new carrier and the old carrier does not influence image formation. Therefore, it is considered to be desirable, because, even if the new carrier and the old carrier exist in a mixed state, image formation can be performed stably with image quality of predetermined level.

In particular, in the image forming apparatus corresponding to an auto-refining development method, old carrier cannot be replaced selectively with new carrier. Therefore, when the concentration of carrier in a replenishment two component developer is made 5% by weight or more and 30% by weight or less, since image formation can be performed stably, it is desirable. In this connection, in the present invention, the concentration of carrier is more preferably made 15% by weight more or less.

Now, a method of filling up toner and carrier on the condition that magnets are made to exist will be explained. In this filling method, first, magnets are arranged on the outer periphery of a container, and then carrier is filled up under this condition. In this way, when carrier is filled under the condition that magnets are arranged on the outer periphery of a container, carrier is filled locally at specific portions in the container upon receipt of the action of magnetic force. Successively, next, toner is filled in the container under the condition that the magnets are arranged on the outer periphery of the container. If toner is filled up under this condition, since the carrier which is filled previously in the container is fixed as a carrier layer with the action of magnetic force, the newly-filled toner is filled as a toner layer in a region where carrier does not exist.

In this way, since toner is filled up under the condition that carrier is fixed by the action of the magnets, even if the previously-filled carrier comes in contact with the filled toner, the carrier does not move. Accordingly, the toner and the carrier are filled such that the toner and the carrier form an independent region respectively without mixing with each other, i.e., form a toner layer and a carrier layer. Then, in a developer storage container, the structure of stacked layers of a toner layer and a carrier layer can be formed. As a result, in a two component developer stored in a developer storage container, it becomes possible to keep the contact condition between toner and carrier as small as possible until the two component developer is fed to a developing device. That is, since the two component developer is made in the condition that occurrence of charge shift due to contact between toner and carrier is suppressed, the reduction of electrically charging properties of a developer is avoided as far as possible, whereby the two component developer which maintains a predetermined electrically charging performance can be fed stably to a developing device.

Moreover, since toner and carrier are preserved on the condition that the toner and carrier are not likely to mix with each other, the opportunity that toner is fixed on the surface of carrier is also reduced. Accordingly, it becomes possible to provide a commercial market with a two component developer in which the reduction of a electric charge providing performance of carrier due to spent toner is not likely to occur. Furthermore, even if a developer storage container filled up with toner and carrier receives shock during transportation, it becomes possible to provide a two component developer which is not likely to receive influence of shock.

Examples of the methods of filling toner and carrier while forming the structure of stacked layers of a toner layer and a carrier layer, in addition to the method of conducting filling by arranging the above magnets, include, for example, a method of conducting filling by controlling factors which regulates the shift direction of a developer and a feeding amount, such as the shape and size of a filling port, a hopper angle and the like. According to these methods, when carrier is filled up, if the carrier is filled up by using a tool shaped in a funnel like a hopper, since the filling is conducted in such a way that the carrier drops in the gravity direction and further shifts along the hopper surface, the carrier can be filled in a container with a diffusing tendency.

Therefore, in addition to the arrangement of magnets, if the filling is conducted by controlling the factors which regulate the shilling direction of a two component developer and a feeding amount, such as the shape and size of a filling port, a hopper angle, and the like, it is considered that the filling of a two component developer can be conducted with higher accuracy. Moreover, when the filling is conducted by arranging magnets, if the arrangement is made such that the strength of magnets arranged in the vicinity of an opening of a container is made weak and the strength of a magnet is made stronger as the position of the magnet becomes closer to the bottom of the container, since carrier becomes to shift easily in the inside of the container, it is preferable in the point that a carrier layer is formed uniformly without unevenness in the container.

Based on FIG. 2*a*, FIG. 2*b*, and FIG. 2*c*, description will be given with reference to a method of perform filling toner and carrier under the condition that magnets are arranged on the outer periphery of a developer storage container. If carrier and toner are filled up under the condition that magnets are arranged on the outer periphery of a container, the carrier and the toner can be filled up while the structure of stacked layers of toner and carrier is being formed in the container. These drawings show schematically the relationship between the arrangement state of magnets 30 on the outer periphery of a container main body B10 and the state of stacked layers of carrier DC and toner DT formed by the arrangement in the container main body B10.

In these drawings, the container main body B10 is shown simply with a cylindrical shape, and the opening B14 for allowing a developer to be filled in the container main body B10 is shown with an upper edge line. Although the arrangement state of the net 30 taken in the filling method of a two component developer according to the present invention is not limited to the arrangements shown in these drawings, the specific arrangement states of the magnet 30 will be explained below.

Figures 2A, 2B, 2C:
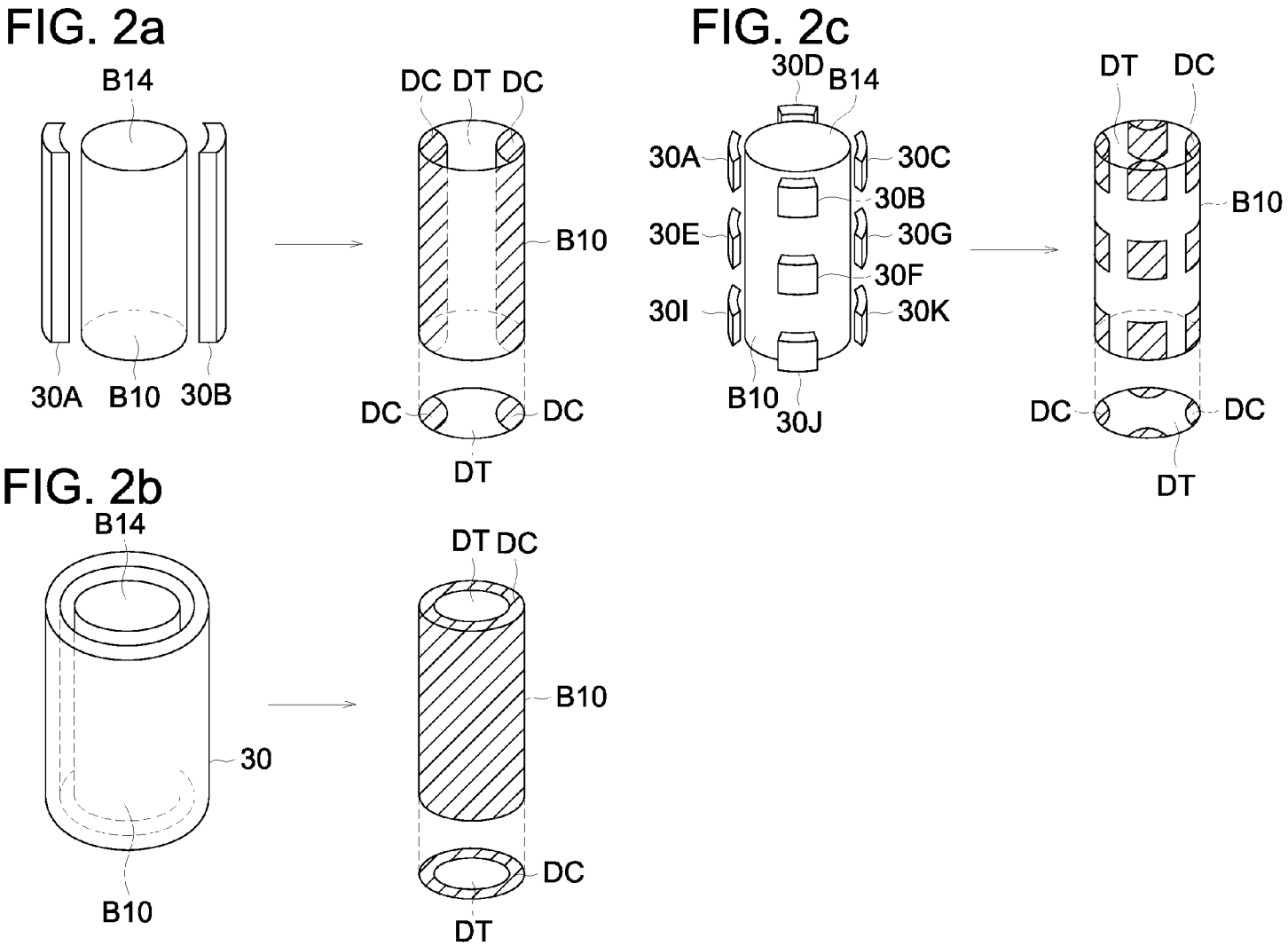
FIGS. 2*a*, 2*b*, and 2*c* each is a schematic diagram showing an arrangement of magnets and a state of stacked layers of toner and carrier formed by the arrangement of magnets.

For example, in FIG. 2*a*, at the outer periphery of a cylindrical container main body B10, two magnets 30A and 30B with the same length as that of the container main body B10 in the lengthwise direction are arranged opposite to each other. On this condition, carrier is filled up, and thereafter toner is filled up. Then, as shown at the right side of the drawing, the carrier DC is filled up locally at the both sides in the cross section of the container, and the toner DT is filled in a region or space from the central portion to the outer peripheral portion where the carrier DC is not filled up.

In FIG. 2*b*, at the outer periphery of a cylindrical container main body B10, a magnet 30 of a cylindrical shape with the same length as that of the container main body B10 in the lengthwise direction is arranged concentrically to the container main body B10. On this condition, carrier is filled up, and thereafter toner is filled up. Then, as shown at the right side of the drawing, the carrier DC is filled up along the outer periphery in the cross section of the container in a configuration like a hollow cylinder and the toner DT is filled up in a central portion of the container in a configuration like a cylinder.

In FIG. 2*c*, among twelve magnets 30A to 30L with the same size, four magnets are arranged around an outer periphery of a cylindrical container main body B10 such that a straight line connecting between a pair of magnets facing each other is perpendicular at the axis of the cylindrical container main body B10 to a straight line connecting between another pair of magnets, and three sets of such four magnets are provided at three different positions in the lengthwise direction of the container main body B10. On this condition, carrier is filled up, and thereafter toner is filled up. Then, as shown at the right side of the drawing, the carrier DC is filled up discontinuously at twelve locations along the outer periphery of the container, and the toner DT is filled up in the other region or space.

As mentioned above, examples of the method of conducting filling while forming a state of stacked layers of a toner layer and a carrier layer in a developer storage container, include a method of conducting filling by controlling the shifting speed, the shifting direction and the feeding amount of each of toner and carrier at a time of filling. For example, if the carrier is filled up by using a tool shaped in a funnel like a hopper, the carrier drops in the gravity direction and further shifts along the hopper surface, the carrier is filled in a container with a diffusing tendency. Further, if the arrangement of magnets is made such that the strength of magnets arranged in the vicinity of an opening portion B14 of a container is made weak and the strength of a magnet is made stronger as the position of the magnet becomes closer to the bottom of the container, since carrier becomes to enter easily the deeper side of the container, it is preferable to form a carrier layer uniformly without unevenness in amount.

Figure 7A:
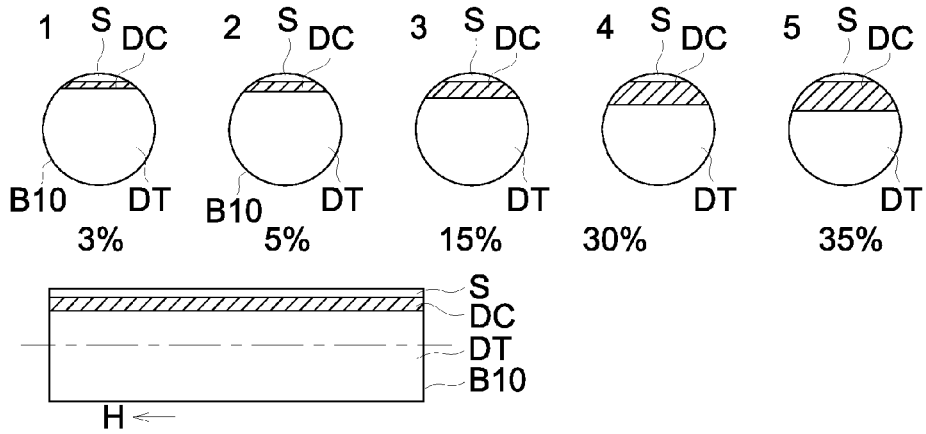
FIGS. 7*a*, 7*b*, 7*c*, and 7*d* each is a schematic diagram showing a developer filling state of samples produced in Example.

In the embodiments mentioned later, 1 to 5 in FIG. 7*a* shows examples in which a two component developer is filled on the condition that magnets are arranged such that the state of stacked layers of a toner layer and a carrier layer is made parallel to the conveying direction of the two component developer caused in a developer storage container when the developer storage container is mounted on an image forming apparatus and the two component developer is fed to a developing device constituting the image forming apparatus.

Figure 7B:
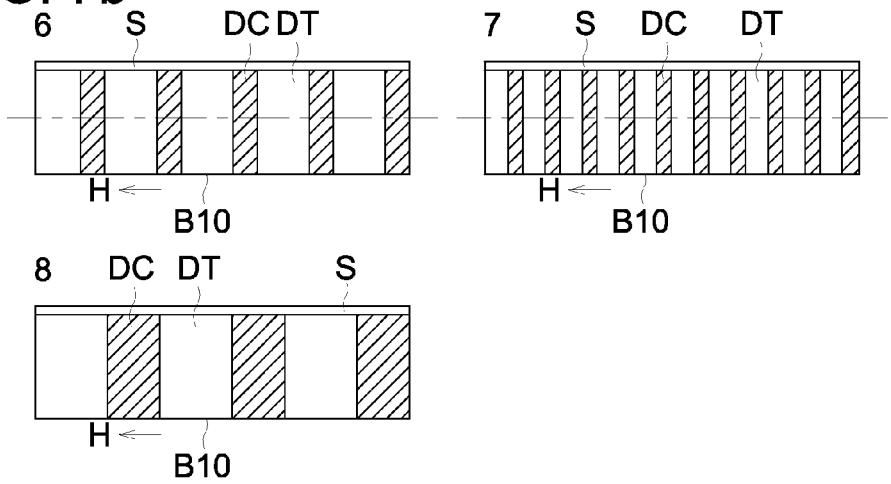

Further, 6 to 8 in FIG. 7*b* shows examples of the filling of a two component developer in which the state of stacked layers of a toner layer and a carrier layer is made perpendicular to the conveying direction of the two component developer caused in a developer storage container when the developer storage container is mounted on an image forming apparatus and the two component developer is fed to a developing device constituting the image forming apparatus. The technique "to fill a two component developer so as to form the state of stacked layers of a toner layer and a carrier layer to be perpendicular to the conveying direction of the two component developer caused in a developer storage container" can be achieved by conducting the filling of toner and the filling of carrier alternately at a time of filling of a two component developer.

Herein, the term "perpendicular" means that when a developer storage container storing a developer is mounted on an image forming apparatus, the state of stacked layers of a toner layer and a carrier layer in the container is made almost perpendicular to the conveying direction of the stored developer. Therefore, the term "perpendicular" includes the ease where the state of stacked layers of a toner layer and a carrier layer in the container is formed obliquely in some degree to the conveying direction of a two component developer caused on the condition that the developer storage container is mounted on an image forming apparatus. That is, the term "perpendicular" does not means to limit to the condition that the state of stacked layers of a toner layer and a carrier layer is exactly perpendicular to the conveying direction of the two component developer, or is formed at 90 degrees to the conveying direction of the two component developer when the developer storage container is mounted on an image forming apparatus.

Figure 7C:
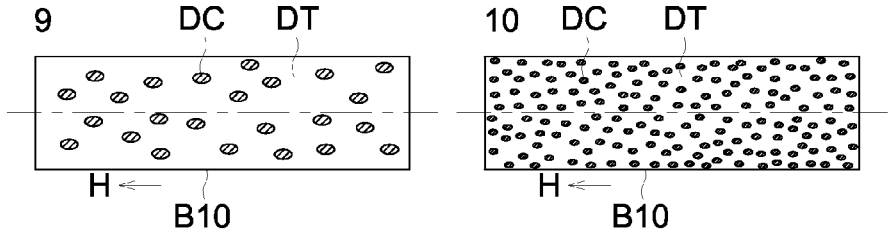
Figure 7D:
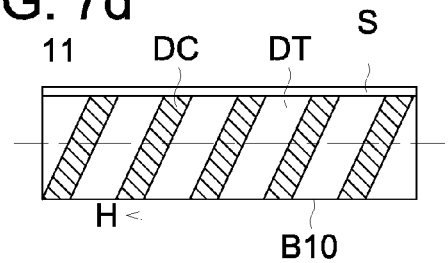

Furthermore, in FIG. 7*d*, a carrier layer forming the state of stacked layers is made in the form of spiral. Such a carrier layer in the form of spiral can be formed in the following procedures. First, carrier is filled in a container, and successively toner is filled so that a carrier layer and a toner layer are faulted in the container. Next, magnets are arranged movably at the outer periphery of the container corresponding to the carrier layer, and then the magnets are moved along the side surface of the container or the bottom surface while the container is being rotated. The carrier filled in the container is moved with the movement of the magnets, and the carrier layer is formed along the wall surface of the container, so that the carrier layers are formed in the form of spiral.

The state of stacked layers including carrier layers in the form of spiral shown in FIG. 7*d* can be formed via the following process specified by the present invention. Namely, the state of stacked layers shown in FIG. 7*d* can be formed via processes of the following (1) to (3) at a time of filling of a two component developer in a developer storage container: (1) a process of filling the two component developer in the cylindrical developer storage container so as to form toner layers and carrier layers; (2) a process of arranging magnets at positions of an outer periphery of the developer storage container where the carrier layers exist; and (3) a process of rotating the developer storage container in which the two component developer is filled up, and moving magnets along the longitudinal direction of the rotated cylindrical developer storage container.

In FIG. 7*a*, FIG. 7*b*, and FIG. 7*d*, a gap S is formed at an upper portion in the container main body. In the present invention, it is desirable that a two component developer is filled in the container main body so as to secure a gap S in the container after the filling. That is, the securing of the gap S in the container body in which a two component developer is filled up allows the developer to be conveyed smoothly by the rotation of the container main body so as to be fed surely in a developing device, whereby a two component developer with a predetermined carrier concentration can be fed surely to a developing device. Further, the existence of the gap S allows toner and carrier to be agitated to a proper degree and to be fed to a developing device in the properly-agitated state. Subsequently, in the developing device, the newly-fed developer and the old developer are unified promptly and the resultant unified developer contributes to image formation to be achieved surely with a predetermined quality.

The filling of a two component developer conducted in the present invention as described above can be achieved by a well-known developer filling apparatus.

That is, as the filling apparatus to fill a developer in a developer store container by forming a state of stacked layers of a toner layer and a carrier layer, for example, a well-known filling apparatus called a transversely-drawing type with a structure that a screw conveyor for conveying carrier is arranged in a horizontal direction can be used for filling carrier. Also, a well-known filling apparatus call a auger type with the structure that a screw conveyor for conveying toner is arranged in the vertical direction can be used for filling toner.

Figure 3:
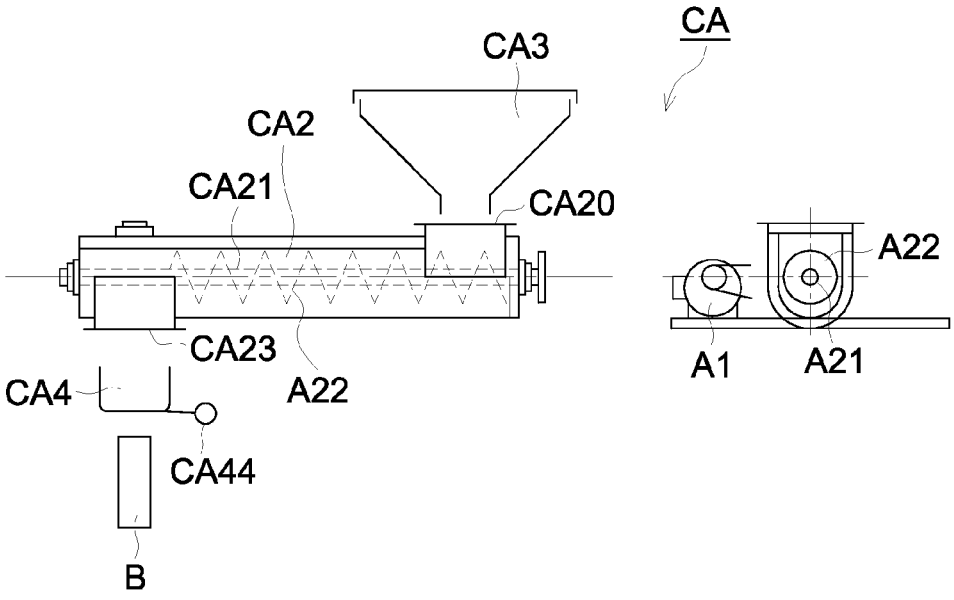
FIG. 3 is an outline drawing of a transversely-drawing type screw conveyor to conduct filling carrier.

FIG. 3 is an outline drawing of a transversely-drawing type screw conveyor with a U type trough specification capable of filling carrier in a developer storage container of the present invention. The screw conveyor filling apparatus CA shown in FIG. 3 includes a driving section CA1, a carrier conveying section CA2, a hopper CA3, and a carrier feeding section CA4. As shown in the drawing, the carrier conveying section CA2 has a carrier carry-in port CA20 positioned just below the hopper CA3 located at the upper portion of its one end and a carrier discharge port CA 22 positioned right above the carrier feeding section CA4 located at a lower portion of its one end opposite to the one end where the carrier carry-in port CA20 is disposed. Further, in the inside of the carrier conveying section CA2, a rotation shaft CA20 shown with a broken line is disposed, and on the outer periphery of the rotation shaft CA20, a screw CA22 to actually convey carrier is provided.

The installation of a well-known control device such as a computer (not shown) allows the screw conveyor CA shown in FIG. 3 to fill a predetermined quantity of carrier automatically in a developer storage container B. In the screw conveyor CA shown in FIG. 3, the driving section CA1 starts driving upon actuation of the computer, and then the rotation shaft CA21 and the screw CA22, which are provided in the carrier conveying section CA2, are rotated by the driving of the driving section CA1. With the rotation of them, carrier C fed from the hopper CA3 via the carrier carry-in port CA20 is conveyed toward the carrier discharge port CA23.

A carrier feeding section (bucket) CA4 to receive the feeding of carrier from the carrier discharge port CA23 is provided with a detecting device CA44 to detect an amount of carrier fed from the the carrier discharge port CA23. When the detecting device CA44 detects that a predetermined amount of carrier is fed to the bucket CA4, the computer (not sown) stops once the feeding of carrier from the carrier conveying section CA2 to the bucket CA4. Then, the predetermined amount of carrier C fed in the bucket CA4 is filled in the developer storage container B. In such procedures, carrier C can be filled in the developer storage container B.

Figure 4:
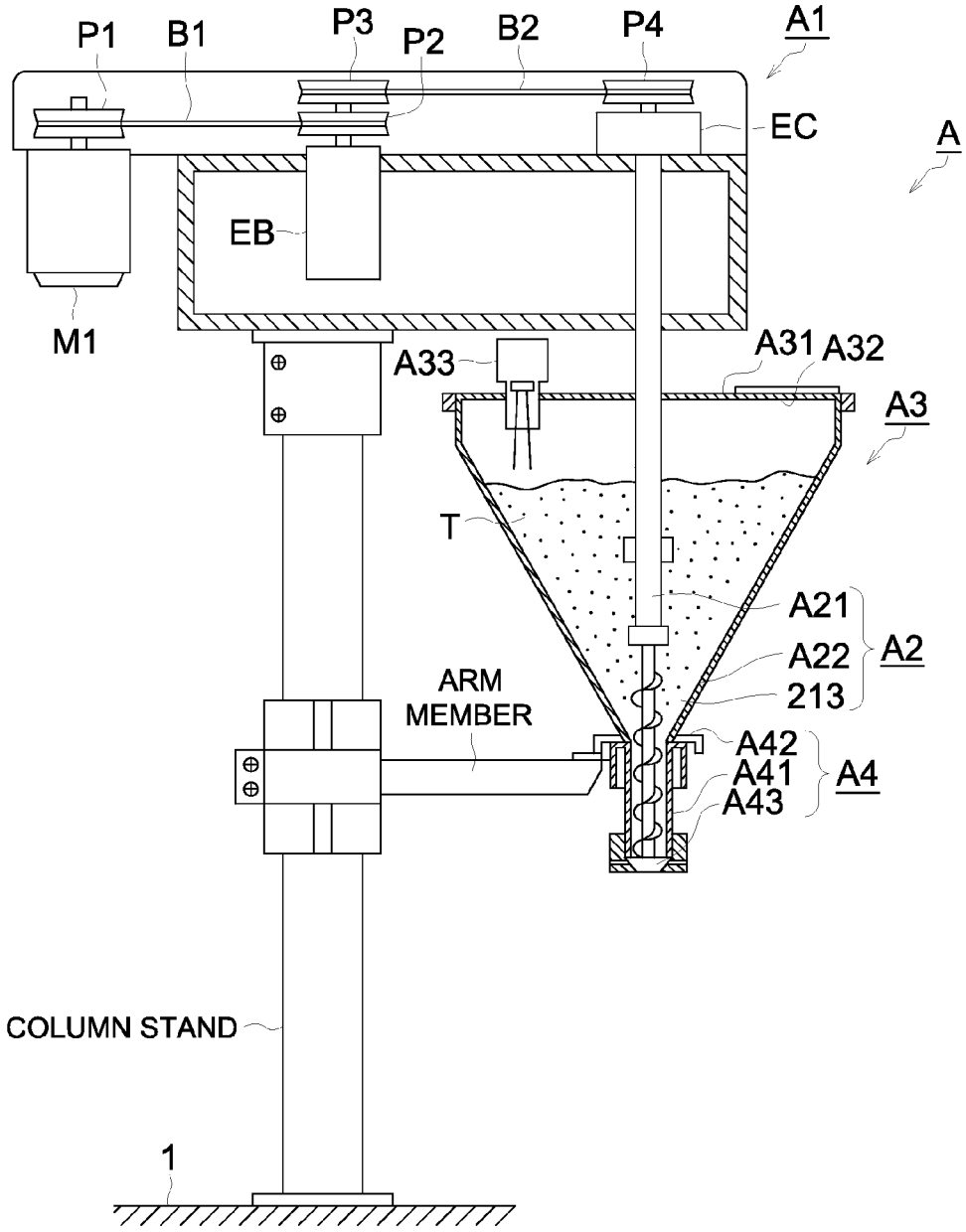
FIG. 4 is an outline drawing of an auger type filling apparatus to conduct filling toner.

Moreover, FIG. 4 is an outline drawing of an auger type filling apparatus which can fill up the developer storage container used in the present invention with toner. The installation of a well-known control device such as a computer (not shown) allows the auger type filling apparatus A shown in FIG. 4 to fill a predetermined amount of toner automatically in the developer storage container B in the following procedures. That is, in the toner filling apparatus A, a driving section A1, which incorporates a driving means therein, is fixed at the upper portion of a column stand made to stand on the fixed base. The driving section A1 is constituted with a drive motor M1, an electromagnetic brake EB, an electromagnetic clutch EC, and a drive transmission means such as pulleys P1, P2, P3, and P4, belts B1 and B2, and the like.

The drive motor M1 starts continuous rotation simultaneously with switch-on of a power source, and idles the electromagnetic brake EB via the pulleys P1 and P2 and the belt B1.

The pulley P3 provided on the same shaft with the pulley P2 transmits drive power via the belt B2 to the pulley 4. The electromagnetic clutch EC provided on the same shaft with the pulley P4 couples the rotation shaft A21 of an auger means A2 to as to rotate timely.

A screw A22 is fixed near the tip portion of the lower portion of the rotation shaft A21 of the auger means A2, and can rotate integrally with the rotation shaft A21.

The lower part of the auger means A2 is accommodated in the hopper A3. The hopper A3 is made in a conical shape and its lower part is connected to the small opening of the toner supply passage A4. The upper part of the hopper A3 forms a wide opening, and is sealed by a top cover A31. A toner feeding port A32 and a sensor A33 are provided to a part of the top cover A31. The sensor A33 detects the top surface of the toner T stored in the hopper A3.

The toner T in the hopper A3 is fluidized by the rotation of the screw A22 of the auger means A2 driven by the drive motor M1, and is conveyed to the successive toner supply passage A4. In this way, the driving section A1 and the auger means A2 of toner filling apparatus A make the toner in the conveyance state.

The toner supply passage A4 acts as a discharge nozzle to supply the toner T to the developer storage container B. As shown in FIG. 4, the toner supply passage A4 is held at the tip portion of the aim member supported on the column stand, and its upper part is connected to the hopper A3. The toner T stored in the hopper A3 is conveyed by the screw A22 in the toner supply passage A4, and is discharged from the discharge opening section A44 via a supply pipe A41 of the toner supply passage A4 so as to be filled up in the developer storage container B. Such procedures make it possible to fill the developer storage container B with the toner T.

As clear from the above-mentioned description of the developer filling method, the two component developer filled up in the developer storage container in the present invention is composed of toner and carrier. Now, description will be given to toner and carrier which constitute the two component developer filled up in the developer storage container in the present invention.

The toner used in the present invention contains at least resin and colorant, is used for image formation by well-known electro-photographing systems, and can be produced by well-known toner production methods. Concretely, the toner can be produced by toner production methods such as so-called pulverization methods which produce toner by processes of kneading, crushing, and classifying, and so-called polymerization methods which polymerize a polymerizable monomer and simultaneously form particles while controlling shape and size. In the case of production of small size toner with a volume-based median size (D50v size) of 3 μm to 9 μm which is used for digital image formation required to reproduce faithfully fine dot images, the polymerization methods are desirable, because particle size and shape can be controlled in their production processes. Among them, preferable is a so-called "emulsification association method" in which resin particles with a size of 20 nm more or less are formed preliminarily by an emulsion polymerization method or a suspension polymerization method and then toner base particles are formed through a process of aggregating these resin fine particles.

The production of toner by the emulsification association method is performed via the following processes, for example: (1) a process of producing a resin fine particle dispersion liquid; (2) a process of adding an aggregating agent in the resin fine particle dispersion liquid and allowing resin fine particles to fuse (associate) to bond with each other until the particles become a predetermined particle size; (3) continuing to heat the dispersing liquid, in which the associated particles are formed, and ripening toner base particles by uniforming the shape of particles; (4) a process of cooling the toner base particles by stopping the heating; (5) a process of washing the formed toner base particles; (6) a process of drying the washed toner base particles; and (7) a process of adding external additive agents on the surfaces of the toner base particles for which the drying process has been finished.

The above-mentioned volume-based median size (D50v size) represents a particle size (50% size) at the time of 50% accumulation in a volume-based particle size distribution. The volume-based median size of toner can be controlled by the concentration and adding timing of the aggregating agent and temperature in the production process. The volume-based median size (D50v size) of toner can be measured and calculated by an apparatus in which "Multisizer 3 (manufactured by Beckman Coulter Company)" is coupled to a computer system for data processing.

The volume-based median size (D50v size) of toner can be measured in the following procedures. First, 0.02 g of toner is made to familiarize itself with 20 ml of a surfactant solution, and then the mixture is subjected to ultrasonic dispersion for one minute, whereby toner dispersion liquid is produced. The toner dispersion liquid is poured by a pipette into a beaker containing "ISOTONII (manufactured by Beckman Coulter) therein in a sample stand until its measurement concentration becomes 5% to 10%, and the size measurement is conducted on the condition that a measuring count is set to 2500 pieces. Further, the aperture size to be used in "Multisizer 3" is 500 μm. Examples of the above-mentioned surfactant solution used for dispersing toner include a solution in which neutral detergent containing a surfactant component is diluted to 10 times with pure water.

Moreover, carrier which constitutes the two component developer used in the present invention is composed of magnetic particles called a core material (core). Examples of carrier include, in addition to carrier in which core material used as the carrier without treatment, so-called resin-coated carrier with the structure that the surface of the core material is covered with a thermoplastic resin. Among them, since the surface of core material is covered with resin, the resin-coated carrier is evaluated as carrier excellent in performance such as durability and frictional electrification properties.

As magnetic particles which form carrier, well-known iron-containing magnetic particles, such as iron, ferrite, magnetite, and the like are employed, and, among them, ferrite particles and magnetite particles are preferably employed.

The particle size of carrier, i.e., the particle size of magnetic particles is 15 μm to 100 μm as a volume-based average particle size, and preferably 20 μm to 80 μm. The volume-based average particle size of carrier can be measured by well-known measuring devices such as a laser diffraction type particle size distribution measuring device "HELOS" (manufactured by SYMPATEC Corporation) and the like.

Examples of resin for covering used for the above-mentioned resin-coated carrier include, without specifically being limited thereto, polyolefine resins, such as styrene resin and styrene acrylic resin; silicon resin; polyester resin; fluorine-containing polymer type resin, and the like.

Next, the production of a two component developer will be explained. A two component developer can be produced by mixing toner and carrier. Although the mixing ratio of carrier and toner is not limited specifically, in the case of production of a replenishment two component developer corresponding to an auto-refining development method, it is desirable that the concentration of carrier is made 5% by weight or more and 30% by weight or less. Further, the mixing of carrier and toner can be achieved by well-know mixing devices, such as a tabular mixer, a Henschel mixer, Nauter mixer, V-type mixer, and the like.

Figure 5:
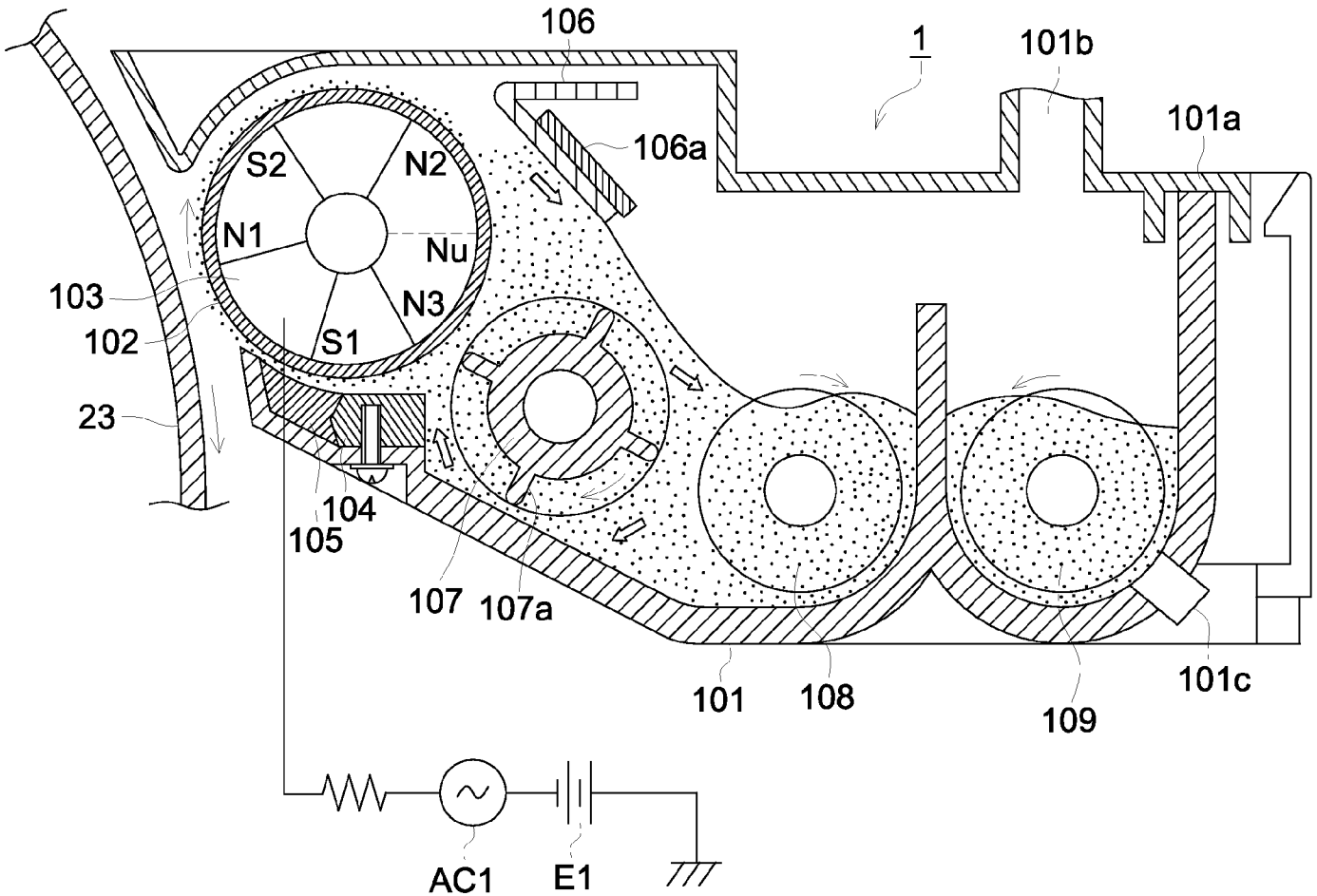
FIG. 5 is an outline view showing one example of a developing device employing an auto-refining development method.

Next, an auto-refining development method will be explained. FIG. 5 shows a cross sectional view of a developing device as one example of the auto-refining development method. The developing device of the "auto-refining development method" shown in FIG. 5 is configured to replenish new carrier as the same time with the replenishment of toner which is consumed by development and to replace carrier little by little so as to maintain the electric charge providing performance of carrier in a developing device. In FIG. 5, an arrowed small line represents the rotation direction of each roller, and an arrowed framed line represents the conveyance direction of developer.

In the drawing, numeral 1 represents a developing device. The developing device 1 includes a housing 101 called a developer storage section which stores two component developer D composed of toner and carrier; a developing sleeve 102 being a developer conveying member which has a magnet roll 103 being a magnetic field generating means incorporating fixed magnetic poles therein; a layer thickness regulating member 104 being a layer thickness regulating means which is made of a magnetic material and regulates the thickness of a developer layer on the developing sleeve 102 to a predetermined value; a reception member 105 made of a nonmagnetic material and configured to guide the developer; a removing board 106 provided with a magnet plate 106*a* on its back surface and configured to removed the developer; a conveying and supplying roller 107 to supply a two component developer D to the developing sleeve 102; and a pair of agitating screws 108 and 109.

The developing sleeve 102 being a developer conveying member is located with a predetermined gap for the peripheral surface of a photoreceptor drum 23 by a spacing roller (not shown) provided at both end of the developing sleeve 102, and is rotated in the direction reverse to the rotation direction (the arrowed direction (clockwise rotation) in the drawing) of the photoreceptor 23. In the inside of the developing sleeve 102, arranged is a magnet roll 103 which has five magnetic poles composed of magnetic poles N1, S1, N2, S2, and N3 required for image formation.

As mentioned above, the magnet roll 103 is incorporated in the developing sleeve 102, have the plurality of magnetic poles N1, N2, N3, S1, and S2 arranged alternately, is fixed coaxially with the developing sleeve 102, and generates magnetic forces acting on the peripheral surface of the nonmagnetic sleeve.

The layer thickness regulating member 104 being a layer thickness regulating means is composed of a magnetic stainless member which is shaped in, for example, a bar or a plate and is located opposite to the magnetic pole N3 of the magnet roll 103, and the layer thickness regulating member 104 regulates the layer thickness of the two component developer on the peripheral surface of the developing sleeve 102.

The reception member 105 is composed of a nonmagnetic member made of resin, such as ABS resin, and the like, and is arranged with a predetermined gap for the developing sleeve 102 at a downstream side in the rotation direction of the developing sleeve 102. The reception member 105 adjoins the end surface of the layer thickness regulating member 104, for example, is fixed via adhesive to the layer thickness regulating member 104 so as to form one body, and prevents toner from being spilled out from the developer layer regulated by the layer thickness regulating member 104. Then, the reception member 105 holds the developer layer of the two component developer D stably on the peripheral surface of the developing sleeve 102. The reception member 105 may be formed by a part of the housing 101.

The removing board 106 to remove the two component developer D is provided opposite to the magnetic pole N2 of the magnet roll 103, and is configured to peel off the two component developer D from developing sleeve 102 by the action between the repelling magnetic field of the magnetic poles N2 and N3 and the magnet plate 106*a* provided on the back surface of the removing board 106.

The conveying and supplying roller 107 conveys the two component developers D peeled off by the removing board 106 to the agitating screw 108, and simultaneously supplies the two component developer agitated by the agitating screw 108 to the layer thickness regulating member 104. The conveying and supplying roller 107 is provided with wing members 107*a* to convey the two component developer.

The agitating screws 108 and 109 are rotated in respective different directions opposite to each other at an equal speed so as to agitate and mix toner and carrier in the developing device 1, whereby the two component developer stored in the developing device 1 is made uniform.

The developing device 1 shown in FIG. 5 has a two component developer replenishing port 101*b* which is provided so as to be able to open on the top plate 101*a* of the housing 101 above the agitating-screw 109, and a two component developer is fed in housing 101 from the two component developer replenishing port 101*b*.

The two component developer fed in the housing 101 is agitated and mixed with the two component developer stored in housing 101 by the agitating screws 108 and 109 which are rotated in respective different directions opposite to each other at an equal speed, whereby the two component developer with the uniform concentration of toner is made uniform. In this way, the two component developer to which a new two component developer is fed is conveyed by the conveying and supplying roller 107 to the layer thickness regulating member 104, and is made in a predetermined layer thickness by the layer thickness regulating member 104. Successively, by passing over the reception member 105, the two component developer forms a developer layer on the peripheral surface of the developing sleeve 102.

Toner constituting the two component developer supplied on the peripheral surface of the developing sleeve 102 is separated from the developing sleeve 102 corresponding to a latent image formed on the photoreceptor drum 23, and is electrostatically adsorbed on the photoreceptor drum 23. At this time, an developing bias voltage in which an alternate current (AC) bias AC1 is superposed on a direct current (DC) bias E1 as required is applied onto an electrostatic latent image on the photoreceptor drum 23, the two component developer can develop the latent image with a reverse development mode on an non contact state (non-contact developing method) to the photoreceptor drum 23. The developing sleeve 102 has a cylindrical shape with a thickness of 0.5 mm to 1 mm and an outer diameter of 15 mm to 25 mm, and is made of nonmagnetic substances, such as stainless steel, aluminum, and the like.

After the latent image on the photoreceptor drum 23 is developed, the two component developer on the developing sleeve 102 is peeled off from the developing sleeve 102 with the action of the repelling magnetic fields of the magnets N2 and N3 and the magnet plate 106*a* provided on the removing board 106, and is conveyed again by the conveying and supplying roller 107 to the agitating screw 108.

When the toner concentration detection sensor 101*c* detects that the concentration of toner in the housing 101 decreases than a concentration of toner, a two component developer is fed to the developing device 1. Here, the concentration of toner represents the ratio of toner which constitutes the two component developer. In the housing 101, although toner is consumed by development among the two component developer, carrier is not consumed. Accordingly, since the ratio of the toner decreases by repeating development, toner corresponding to the consumed amount is required to be replenished.

In the developing device 1 shown in FIG. 5, the replenishment of carrier is conducted as the same time with the replenishment of toner. The two component developer used for the developing device 1 shown in FIG. 5 contains carrier in an amount of 5% by weight or more and 30% by weight or less. Further, in the developing device 1 shown in FIG. 5, the replenishment two component developer is fed in the housing 101, and as a result, when the two component developer is stored in an amount exceeding a predetermined amount in the housing 101, the excessive developer is discharged from the developing device timely. In this way, tone is fed corresponding to the toner consumed by development, and also carrier is fed simultaneously. Further, the carrier stored in the developing device is replaced little by little so as to suppress a change in electrostatic charge amount and to stabilize the developing density. Such a development method is called an auto-refining development method.

The two component developer D is replenished to the developing device 1 in such a way that two component developer D is replenished from the hopper 26*b* shown in FIG. 6 mentioned later through the two component developer replenishing port 101*b* to the developing device 1. The two component developer replenished in the developing device 1 is fully agitated by the agitating screws 108 and 109, at this time, toner is also charged by agitation. The resultant two component developer is conveyed to the developing sleeve 102, and is supplied to the photoreceptor 23.

The amount of the two component developer D stored in the housing 101 increases by the replenishment of the two component developer D. The amount of the two component developer D stored in the housing 101 is detected by a surface level detecting means (not shown). When the surface level detecting means detects that the stored amount of the two component developer D exceeds a specified amount, the agitating screws 108 and 109 are rotated in the directions reverse to the directions at the time of normal development, whereby the excessive developer is discharged by a discharging means (not shown).

Figure 6:
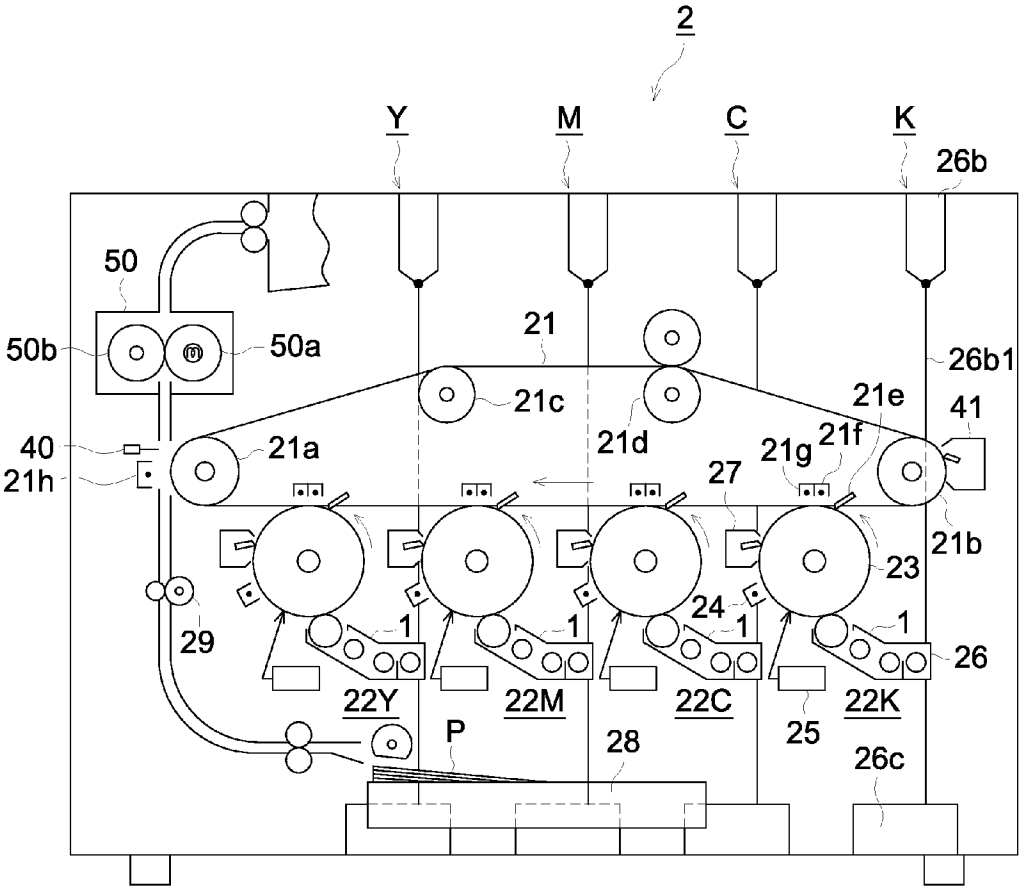
FIG. 6 is a schematic view showing one example of an image forming apparatus on which a developing device employing an auto-refining development method is mounted.

The discharged developer is conveyed by the discharging means (not shown) which starts rotation simultaneously with the reverse rotation of the agitating screw 109, and is collected in a recovery container 26*c* shown in FIG. 6.

In this way, the developer in the housing 101 is discharged, and when the surface level detecting means detects that the stored amount of the two component developer D in the housing 101 becomes the standard level, the agitating screws 108 and 109 stop the reverse rotation, and then stop the discharging of the developer. After stopping the discharging of the developer, the agitating screws 108 and 109 return to the normal rotation.

Next, on the basis of FIG. 6, explanation will be made about toner image formation by use of an image forming apparatus on which the developing device 1 shown in FIG. 5 can be mounted.

FIG. 6 is a schematic diagram showing an example of the image forming apparatus on which the developing device 1 shown in FIG. 5 can be mounted, and the image forming apparatus 2 is made in a system called a tandem type color image forming apparatus. In this regard, the developer storage product, which stores the two component developer filled up with the filling method of the two component developer according to the present invention, is not limited only to be used for the image forming apparatus shown in FIG. 6.

The image forming apparatus 2 shown in FIG. 6 includes a plurality of image forming members arranged in parallel, and the structure and function are as described below. Four sets of process units 22Y, 22M, 22C, and 22K to form a yellow (Y) image, a magenta (M) image, a cyan (C) image, and a black (K) image are provided around the peripheral portion of a transfer belt 21 being an intermediate transfer member. The process units 22Y, 22M, 22C, and 22K form respective monochromatic toner images of yellow (Y), magenta (M), cyan (C), and black (K), and these monochromatic toner images are transferred and superimposed so as to form color image on the transfer belt 21. The resultant color image formed on the transfer belt 21 by the transfer is successively transferred collectively on a recording sheet P, and the color image transferred on the recording sheet P is fixed by a fixing device, and then the recording sheet P is discharge outside the apparatus.

The above-mentioned process unit 22 has a photoreceptor drum 23 being an image forming member, and around the photoreceptor drum 23, provided are a scorotron charging unit 24 to charge the photoreceptor drum 23, an exposure optical system 25 to form a latent image on the photoreceptor drum 23, a developing device 1 to supply toner to the photoreceptor drum 23, and a cleaning apparatus 27 to remove toner, which becomes unnecessary, from the photoreceptor drum 23.

In the photoreceptor drum 23, an organic photosensitive layer provided with an overcoat layer (protective layer) is formed on the peripheral surface of a cylindrical metal base body made of metal such as aluminum. In the image forming apparatus 2 shown in FIG. 6, the photoreceptor drum 23 is configured to come in contact with the transfer belt 21 and is rotated in the arrowed direction in the drawing by receiving the driving force from the transfer belt 21 through the contact.

The scorotron charging unit 24 has a grid-shaped corona discharge electrode provided with a predetermined potential in order to conduct corona discharge, and is adapted to conduct charging with the same polarity with toner to be supplied to the photoreceptor drum 23, whereby the surface of photoreceptor drum 23 is provided electric charge uniformly. As the corona discharge electrode of the scorotron charging unit 24, a saw tooth-like electrode a needlelike electrode may be employed as well as the grid-shaped electrode.

The exposure optical system 25 is arranged at the downstream side of the scorotron charging unit 24 in the rotation direction of the photoreceptor drum 23. The exposure optical system 25 is configured to conduct image exposure onto the photosensitive layer of the photoreceptor drum 23 in accordance with to image data which is read by an image reading device (not shown) and is memorized in a memory, and an electrostatic latent image is formed on the photoreceptor drum 23 by image exposure.

As explained with reference to FIG. 5, the developing device 1 has a developing sleeve 102 which maintains a predetermined gap for the peripheral surface of the photoreceptor drum 23 and is the rotated in the same direction with the rotation direction of the photoreceptor drum 23, and the developing device 1 stores a two component developer in its inside. The developing sleeve 102 is provide with a gap of 100 μm to 500 μm between it and the photoreceptor drums 23 by a spacing roller (not shown). By the application of a developing bias of a direct current voltage or a direct current voltage including a superposed alternate current voltage to the developing sleeve 102, the developer held on the developing sleeve 102 is supplied to the photoreceptor drum 23, whereby development is conducted. In this way, the latent image formed on the photoreceptor drum 23 is developed.

The developing device 1 has a hopper 26*b* to feed a two component developer, and a recovery container 26*c* to collect a two component developer discharged from the developing device 1. As explained with reference to FIG. 5, in the developing device 1, a toner concentration detection sensor detects the concentration of toner in the two component developer in the developing device 1, because the toner is consumed by repeated development. Based on the detection result, new developer is fed from the hopper 26*b* through the replenishing pipe 26*b*1.

The ration of toner to carrier in the two component developer fed to the developing device 1 is set up to become the ration of toner to carrier in the developing device in the normal state. As mentioned above, the ratio is set to increase toner in an amount more than carrier.

The supplied two component developer agitation is mixed and agitated with the old two component developer in the developing device 1. As mentioned above, in the case where the two component developer is stored excessively by replenishment in the housing 101, and the surface level detecting means detects that the stored amount of the two component developer D exceeds a specified amount, the excessive developer is discharged to the outside of the system by a discharging means such as a screw pump. In this way, replenishing and discharging are repeated so that the performance of the two component developers in the developing device can be stabilized.

On the photoreceptor drum 23 which is charged uniformly by the scorotron charging unit 24, the exposure optical system 25 conducts image exposure so as to form an electrostatic latent image, and the developing device 1 develops the latent image so as to form a toner image. This toner image is transferred onto the transfer belt 21 at a transfer position.

The toner remaining on the photoreceptor drum 23 after the transferring is removed by the cleaning apparatus 27 which collects electrostatically the remaining toner.

The transfer belt 21 on which monochromatic toner images formed by the plurality of process units are transferred so as to be superimposed, is an endless member composed of a conductive film-like substrate. In order to prevent the occurrence of toner filming, a surface layer may be provided on the substrate. The substrate constituting the transfer belt 21 is made of a commercially-available film-like plastic material in which a conductive material is dispersed, and the substrate has a thickness of 0.1 mm to 1.0 mm and a volume resistivity of $10^{12}$ Ωcm to $10^{15}$ Ωcm. Further, in the case where a surface layer is provided on the substrate, thickness of the surface layer is preferably 5 μm to 50 μm.

Examples of the film-like plastic materials usable as the substrate, include resin materials, such as modified polyimide, heat curable polyimide, ethylene tetrafluoroethylene copolymer, polyvinylidene fluoride, and a nylon alloy; and rubber materials, such as silicone rubber and polyurethane rubber.

The transfer belt 21 is stretched so as to circumscribe a driving roller 21*a*, a follower roller 21*b*, a tension roller 21*c*, and a backup roller 21*d*. At the time of image formation, the driving roller 21*a* is driven and rotated by a motor (not shown), and then the transfer belt 21 is rotated by this revolution in the arrowed direction shown in the drawing. At this time, the transfer belt 21 is pressed toward each of the photoreceptor drums 23 by respective pressing elastic plates 21*e* each arranged at the upstream side of the transfer position of each of the process units, and in turn, each of the photoreceptor drums 23 is driven and rotated by the transfer belt 21. The pressing elastic plate 21*e* is formed by the processing by which rubber materials, such as polyurethane, is shaped in the form of a blade.

At the transfer position formed by the transfer belt 21 and each of the photoreceptor drums 23, a primary transfer device 21*f* is arranged opposite to the photoreceptor drum 23 across the transfer belt 21 so as to form a transfer region between the both members.

The primary transfer device 21*f* is constituted by a corona discharge device and the like, and applies a direct current voltage with a polarity reverse to that of toner onto the transfer region so as to form a transfer electric field, whereby a toner image on each of the photoreceptor drums 23 is transferred onto the transfer belt 21.

Further, at the transfer position, an electric-charge elimination device 21*g* constituted by a corona discharge device is arranged so as to adjoin the above-mentioned primary transfer device 21*f*, and conducts electric charge elimination for the transfer belt 21 charged by the primary transfer device 21*f*.

With the above-mentioned procedures, toner images formed on the photoreceptor drums 23 of the process units of yellow (Y), magenta (M), cyan (C), and black (K) are transferred one by one and superimposed on the transfer belt 21 so as to form a color toner image on the transfer belt 21.

Subsequently, after the toner images are transferred onto the transfer belt 21, the cleaning devices 27 remove toner remaining on the peripheral surface of the photoreceptor drums 23 of the process units 22 of yellow (Y), magenta (M), cyan (C), and black (K).

In synchronization with color toner image formation by the superposition onto the transfer belt 21, a transfer material (recording paper) P being an image supporting substrate is conveyed from a sheet paper cassette 28 via a timing roller 29 to a transfer area where a secondary transfer device 401*h* is arranged. In this transfer area, the secondary transfer device 401*h* applies a direct current voltage with a polarity opposite to that of toner onto the recording paper P, whereby the superposed color toner image formed on the transfer belt 21 is transferred collectively onto the recording paper P by the secondary transfer device 21*h*.

Subsequently, after the superposed color toner image is transferred onto the recording paper P, toner remaining on the peripheral surface of the transfer belt 21 is removed by a transfer belt-cleaning apparatus 41 which is arranged opposite to the follower roller 21*b* across the transfer belt 21.

The recording paper P onto which the color toner image is transferred is subjected to electric charge elimination by an electric charge eliminating electrode 40 composed of a saw tooth-shaped electrode plate, and then the recording paper P is conveyed to the fixing device 50. In the fixing device 50, when the recording paper P passes through between the heating roller 50*a* and the pressing rollers 50*b*, heat and pressure are applied onto the recording paper P, whereby a color toner image is fixed on the recording paper P. Subsequently, the recording paper P on which the color toner image is fixed is discharged to the tray provided at the outside of the apparatus.

With the above procedures, the image forming apparatus shown in FIG. 6 forms a color toner image. During the color image formation, the developing device constituting the image forming apparatus performs an auto-refining development, whereby an amount of electric charge of toner can be stabilized for a long period of time, and image formation can be stabilized to provide good finish.

The recording paper P being an image supporting substrate is to hold a toner image, and may be also called a transfer material or a transfer paper. Specific examples of the recording paper P include, without being limited thereto, regular paper from thin paper sheet to thick paper sheet; coated print sheets, such as art paper and coated paper; commercially-available Japanese paper and postcard sheet; plastic film for OHP; cloth; and the like.

Example

Although the embodiments of the present invention will be explained concretely hereafter by examples, the present invention is not limited to these examples.

1. Preparation of "Replenishment Developer 1"

Commercially available black toner with a volume-based median size of 6.5 μm and a specific gravity of 1.05 was prepared. The black toner was made of styrene acrylic polymer resin produced in accordance with the procedures of the above-mentioned emulsification association method. Further, commercially available resin-coated carrier with a specific gravity of 3.50 was prepared. In the resin-coated carrier, the surfaces of ferrite core particles with a volume-based median size of 40 μm were covered with a methyl acrylate resin.

2. Preparation of "Samples 1 to 11"

The developer storage containers B shown in FIG. 1 were filled up with toner and carrier such that 11 kinds of "Samples 1-11" were prepared.

(1) Preparation of "Samples 1 to 5"

In order to form the structure of stacked layers of a carrier layer and a toner layer in parallel to the developer conveyance direction in a developer storage container, on the condition that bar-shaped magnets having the same length with the longitudinal length of the developer storage container were arranged, the carrier was filled up, and then the toner was filled up, whereby "Samples 1 to 5" were prepared. "Samples 1-5" were different in carrier concentration as shown in Table 1. Such different carrier concentration was made by adjustment of both of the arrangement of the bar-shaped magnets and the number of the bar-shaped magnets. The filling states of toner and carrier in the developer storage container in "Samples 1 to 5" are shown schematically in FIG. 7*a*.

(2) Preparation of "Samples 6 to 8"

Toner and carrier were filled alternately in the developer storage container, whereby "Samples 6 and 7" with a carrier concentration of 15% were prepared. In "Sample 6", on the assumption that toner and carrier are supplied respectively when a developer is supplied to the developing device, toner and carrier were filled up alternately separately by multiple times. Further, in "Sample 7", toner and carrier were filled up alternately with a filling time at one time which was set to ½ (half) of that in "Sample 6". Furthermore, in "Sample 8", toner and carrier were filled up alternately with a filling time at one time which was set to two times that in "Sample 6". The filling states of toner and carrier in the developer storage container in "Samples 6 to 8" are shown schematically in FIG. 7*b*.

(3) Preparation of "Samples 9 to 10"

"Samples 9 to 10" were prepared in such a way that a structure of stacked layers of a toner layer and a carrier layer was not formed when a developer storage container was filled with the above toner and carrier.

In "Sample 9", the toner and the carrier were prepared so as to provide a carrier concentration of 15%, and simply mixed and stirred, and then the resulting mixture was filled in a developer storage container.

Further, in "Sample 10", the toner and the carrier were prepared so as to provide a carrier concentration of 15%, and mixed and stirred sufficiently so as to form a uniform mixture state, and then the resulting uniform mixture was filled in a developer storage container. The filling states of toner and carrier in the developer storage container in "Samples 9 and 10" are shown schematically in FIG. 7*c*.

(4) Preparation of "Sample 11"

The carrier corresponding to a carrier concentration of 15% was filled in a developer storage container, and then toner was filled in on the fowled carrier layer so that a structure of stacked layers of two layers of the carrier layer and the toner layer was formed.

Next, magnets were arranged on the outer periphery of the container corresponding in position to the carrier layer. Then, on this condition, while the developer storage container was being rotated, the magnets were shifted back and forth along the lengthwise direction of the container so as to move the carrier layer, whereby "Sample 11" with a spiral-shaped toner layer shown in FIG. 7*d* was prepared.

Table 1 shows the developer filling method at the time of preparation, the filling state of the developer, the carrier concentration set up at the time of filling, dispersion in carrier concentration at the time of supply of a developer to a developing device with regard to "Samples 1-11" prepared by the above-mentioned procedures.

The "dispersion in carrier concentration" was measured by use of the same developer supply unit as that which was used in an image forming apparatus used for an evaluation test. The developer supply unit was configured to mount a developer storage container thereon and to rotate a container body of the mounted developer storage container so as to feed a developer to a developing device. Concretely, the "dispersion in carrier concentration" was measured by the following procedures. (1) First, "Sample" was set on the unit, and a developer storage container was rotated by actuation of a driving means so as to convey a stored developer to a developer supply port. (2) A 100-ml measuring cylinder was prepared, and placed at the developer supply port. Then, 20 ml of a developer discharged from the developer supply port was sampled by the measuring cylinder. (3) The sampled developer was separated into toner and carrier, and the weight of each of the toner and the carrier was measured. Then, the carrier concentration in the developer discharged from the supply port was calculated from the measurement results. (4) The above operations were repeated by five times for each Sample, and the average carrier concentration of the five measurements was calculated. (5) A difference between the calculated average value and the carrier concentration set at the time of filling was calculated and the difference was made as the "dispersion in carrier concentration".

TABLE 1

| | Developer filling condition | | Carrier | Dispersion in carrier concentration at the time |
|---|---|---|---|---|
| Sample No. | Filling method | Filling state | concentration (weight %) | of supply (weight %) |
| 1 | Filling via magnet | Stacked-layer structure | 3 | ±1.0 |
| 2 | Filling via magnet | Stacked-layer structure | 5 | ±1.5 |
| 3 | Filling via magnet | Stacked-layer structure | 15 | ±2.0 |
| 4 | Filling via magnet | Stacked-layer structure | 30 | ±2.0 |
| 5 | Filling via magnet | Stacked-layer structure | 35 | ±2.0 |
| 6 | Alternate filling | Stacked-layer structure | 15 | ±5.0 |

TABLE 1-continued

| Sample No. | Developer filling condition: Filling method | Developer filling condition: Filling state | Carrier concentration (weight %) | Dispersion in carrier concentration at the time of supply (weight %) |
|---|---|---|---|---|
| 7 | Alternate filling | Stacked-layer structure | 15 | ±3.0 |
| 8 | Alternate filling | Stacked-layer structure | 15 | ±8.0 |
| 9 | Filling with mixture | Uniform structure | 15 | ±13.5 |
| 10 | Filling with mixture | Uniform structure | 15 | ±3.5 |
| 11 | Filling via magnet | Stacked-layer structure | 15 | ±3.5 |

3. Evaluation Test

The above "Samples 1 to 11" were mounted on the image forming apparatus having the structure shown in FIG. 6 which incorporates the developing device with the structure shown in FIG. 4, and consecutive printing was carried out to print 20,000 sheets. Among the 20,000 sheets, the first sheet at the time of start of the consecutive printing, the 3000th sheet, and the 20,000th sheet were evaluated in terms of the developer performance and image quality. In this regard, the evaluations of "Samples 1 to 8 and 11", in which the structure of stacked layers of a toner layer and a carrier layer was formed in the developer storage container, were made as "Examples 1 to 9", and the evaluations of "Samples 9 and 10", in which the structure of stacked layers of a toner layer and a carrier layer was not formed, were made as "Comparative examples 1 and 2".

(1) Evaluation of the Developer Performance

A proper amount of the developer was sampled from the developing device during the above consecutive printing, and then, the electric charge amount of toner constituting the sampled developer was measured and carrier contamination due to spent toner was evaluated.

<Measurement of the Electric Charge Amount of Toner>

Figure 8:
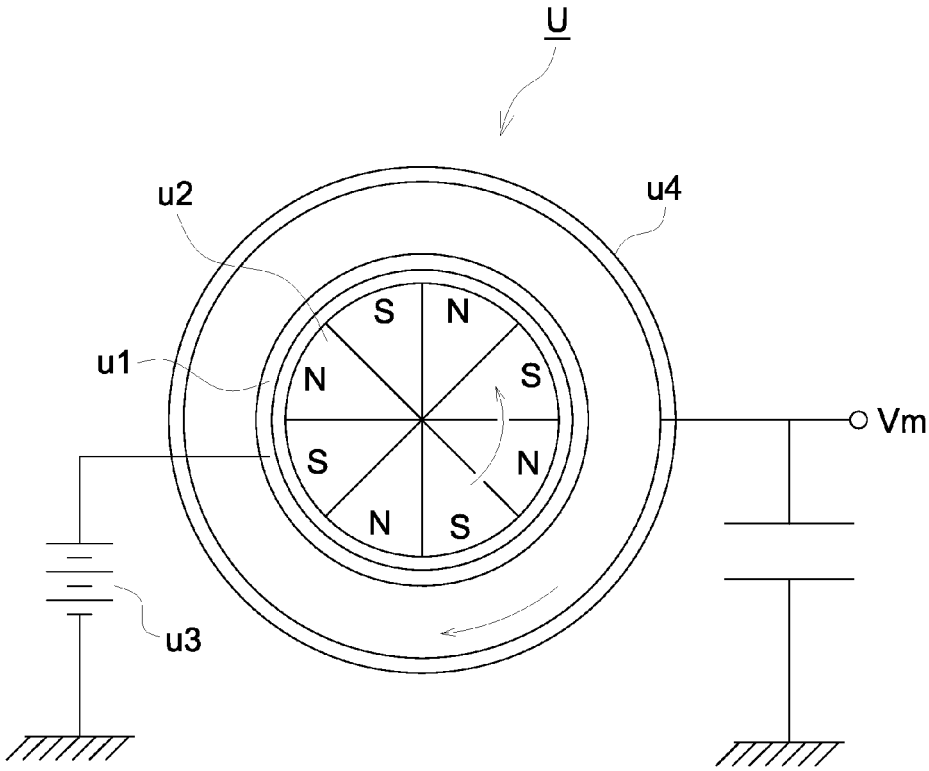
FIG. 8 is an outline drawing of a charge amount measuring device used for measuring a charge amount f toner in Example.

The measurement of the electric charge amount of toner was conducted by use of an electric charge amount measuring apparatus U shown in FIG. 8. First, 0.5 g of toner weighed with a precision balance weight scale was supplied uniformly on the entire surface of a conductive sleeve u1 which constitutes the device U. Next, while a voltage of −3 kV was being applied to the conductive sleeve u1 from a bias power source u3, the rotation number of a magnet roll u2 provided in the conductive sleeve u1 was set to 1000 rpm. On this condition, the device U was left stand for 70 seconds, and then the toner were collected to a cylindrical electrode u4. After the device U was left stand for 70 seconds, the electric potential Vm of the cylindrical electrode u4 was read out, the electric charge amount of toner was calculated from the read-out value. Successively, the weight of the collected toner was measured by the precision balance weight scale, and the average electric charge amount was obtained. In the case that the absolute value of the electric charge amount of toner was 25 μc/g or more and a difference in the electric charge amount of toner between before and after the consecutive printing was 10 μc/g or less, the evaluation was made as "acceptance" (A), and especially, in the case that the electric charge amount of toner was 30 μc/g or more even after the consecutive printing, the evaluation was made as "specific excellence" (AA).

<Evaluation of the Carrier Contamination Due to the Occurrence of Spent Toner>

The developer was sampled at the time of each of the 3,000th sheet and the 20,000th sheet and the toner adhering on the surface of the carrier in the developer was made spent toner in the following ways. Subsequently, the evaluation of the carrier contamination due to the occurrence of spent toner was made as follows.

(Preliminary Preparation Processing)

The developer, a small amount of neutral detergent, and pure water were put into a beaker, and were made familiar with each other. Then, a magnet was applied to the bottom of the beaker, and a supernatant solution was thrown away. Next, an operation which adds pure water into the beaker and throw away a supernatant solution was repeated so as to remove the toner and the neutral detergent and to separate only the carrier. The separated carrier was subjected to dry treatment at 40° C. so as to obtain a carrier single body.

(Measurement)

Into a sample tube with a capacity of 30 ml, 10 g of the carrier separated from the developer by the above-mentioned preliminary preparation processing was put, and 20 g of methyl ethyl ketone was added, and stirred for 30 minutes. Subsequently, a supernatant solution was extracted. The extracted supernatant solution was set in a spectrophotometer "U-3500 (manufactured by Hitachi, Ltd.)", the transmission optical density of the supernatant solution was measured with a 650 nm wavelength light flux so as to obtain transmittance. The evaluation was made based on the following evaluation criteria, and in the case where the transmission optical density was 0.85 or more, it was evaluated that there was no problem of the carrier contamination due to spent toner.

(Evaluation Criteria)

AA: The transmission optical density was 0.95 or more, and the carrier contamination due to spent toner did not occur.

A: Although the transmission optical density was 0.85 or more and less than 0.95 and the occurrence of spent toner was observed slightly, these factors were acceptable in the point of commercial use.

C: The transmission optical density was less than 0.85, and the occurrence of the carrier contamination due to spent toner was observed.

(2) Image Evaluation

At the time of each of start of the consecutive printing, the 3000th sheet, and the 20,000th sheet, a solid black image sample print and a white image sample print were made, and then the image density on the solid black image sample print and a fog density on the white image sample print were measured and evaluated.

<Image Density Evaluation>

On a sheet of an A4 size, a solid black image was printed, and the image density of the printed solid black image was measured by a commercially available reflection density meter "RD-918 (manufactured by Macbeth Corporation)". In the reflection density measurement, the reflection density of a sheet (white sheet) on which no image was printed was made to "0", and the image density was measured as the relative reflection density to that of the white sheet. In the case where the reflection density was 1.0 or more during the period from the start of the consecutive printing to the completion of printing of 20,000 sheets, the evaluation was made as "acceptance" (A), and especially, in the case that a reflection density of 1.2 or more was maintained, the evaluation was made as "specific excellence" (AA).

<Fog Density Evaluation>

First, the reflection density of each of arbitrary 20 positions on an A4-size paper sheet (white paper sheet) on which no image was printed was measured by a commercially available reflection density meter "RD-918 (manufactured by Macbeth Corporation)", and the average value of these measurement values was made as a white sheet density. Next, a white background image for fog density evaluation was printed on an A4 size paper sheet with the same specification as the above-mentioned white paper sheet, the reflection density of each of arbitrary 20 positions on the printed white background image was measured, an average value of these measurement values was calculated, and a value obtained by subtraction of the above white sheet density from the calculated average value was made as a fog density. In the case where the fog density was 0.01 or less during the period from the start of the consecutive printing to the completion of printing of 20,000 sheets, the evaluation was made as "acceptance" (A), and especially, in the case that a fog density of 0.005 or less was maintained, the evaluation was made as "specific excellence" (AA).

The above results are shown in Table 2.

TABLE 2

| | | Electric charge amount of toner (μc/g) | | | | Spent toner evaluation | | | |
|---|---|---|---|---|---|---|---|---|---|
| | Sample No. | At the time of start | The 3,000th sheet | The 20,000th sheet | Judgment | The 3,000th sheet | The 20,000th sheet | Judgment | At the time of start |
| *1 | 1 | 33 | 28 | 26 | A | 0.93 | 0.89 | A | 1.24 |
| *2 | 2 | 33 | 32 | 30 | AA | 0.97 | 0.94 | A | 1.24 |
| *3 | 3 | 34 | 34 | 33 | AA | 0.98 | 0.97 | AA | 1.24 |
| *4 | 4 | 34 | 34 | 34 | AA | 0.97 | 0.97 | AA | 1.24 |
| *5 | 5 | 34 | 34 | 34 | AA | 0.98 | 0.98 | AA | 1.24 |
| *6 | 6 | 33 | 30 | 28 | AA | 0.97 | 0.94 | A | 1.23 |
| *7 | 7 | 34 | 27 | 25 | A | 0.91 | 0.86 | A | 1.24 |
| *8 | 8 | 33 | 30 | 26 | A | 0.96 | 0.88 | A | 1.23 |
| *9 | 11 | 33 | 33 | 31 | AA | 0.96 | 0.95 | AA | 1.23 |
| Comp. 1 | 9 | 34 | 24 | 18 | C | 0.84 | 0.77 | C | 1.23 |
| Comp. 2 | 10 | 34 | 22 | 17 | C | 0.81 | 0.73 | C | 1.24 |

| | | Solid black image density | | | Fog density | | | |
|---|---|---|---|---|---|---|---|---|
| | Sample No. | The 3,000th sheet | The 20,000th sheet | Judgment | At the time of start | The 3,000th sheet | The 20,000th sheet | Judgment |
| *1 | 1 | 1.17 | 1.07 | A | 0.003 | 0.004 | 0.006 | A |
| *2 | 2 | 1.23 | 1.20 | AA | 0.003 | 0.004 | 0.004 | AA |
| *3 | 3 | 1.24 | 1.23 | AA | 0.002 | 0.002 | 0.002 | AA |
| *4 | 4 | 1.23 | 1.22 | AA | 0.002 | 0.003 | 0.004 | AA |
| *5 | 5 | 1.22 | 1.18 | A | 0.004 | 0.006 | 0.008 | A |
| *6 | 6 | 1.20 | 1.20 | AA | 0.003 | 0.004 | 0.004 | AA |
| *7 | 7 | 1.15 | 1.05 | A | 0.003 | 0.006 | 0.008 | A |
| *8 | 8 | 1.14 | 1.08 | A | 0.003 | 0.004 | 0.007 | A |
| *9 | 11 | 1.20 | 1.18 | A | 0.003 | 0.004 | 0.005 | A |
| Comp. 1 | 9 | 1.04 | 0.92 | C | 0.003 | 0.012 | 0.014 | C |
| Comp. 2 | 10 | 0.96 | 0.88 | C | 0.003 | 0.013 | 0.018 | C |

*Example,
Comp.: Comparative example

As shown in Table 2, in "Examples 1 to 9" in which the two component developer was filled so as to form a state of stacked layers of a toner layer and a carrier layer in the developer storage container, fluctuation of the electric charge of toner and carrier contamination due to spent toner did not occur during the consecutive printing, and prints were able to be produced with stable image quality. On the other hand, in "Comparative examples 1 and 2" in which the two component developer was filled so as not to form the state of stacked layers of a toner layer and a carrier layer in the developer storage container, the electric charge of toner decreased with the progress of the consecutive printing, and carrier contamination occurred due to spent toner. As a result, their influence appeared appreciably on image quality. From the results of the above examples, it was confirmed that the filling method of a two component developer according to the present invention makes it possible to obtain the effects that the contact are between toner and carrier in a developer storage container can be suppressed so as to stabilize the quality of the developer.

Hereafter, the desirable embodiment of the present invention is summarized.

That is, the method of Item 1 is a two component developer filling method of filling a two component developer containing at least toner and carrier in a developer storage container, and is characterized by filling the above-mentioned two component developer in the developer storage container so as to form the state of stacked layers in which a toner region and a carrier region are separated.

The method of Item 2 is the two component developer filling method described in Item 1, and is characterized in that a carrier concentration in the two component developer is 5% by weight or more and 30% by weight or less.

The method of Item 3 the two component developer filling method described in Item 1 or 2, and is characterized in that the developer storage container feeds the stored two component developer to a developing device constituting an image forming apparatus on the condition that the developer storage container is mounted on the image forming apparatus, and the two component developer is filled so as to form the toner region and the carrier region in parallel to the conveyance direction of the two component developer caused in the developer storage container when the two component developer is fed to the developing device on the condition that the developer storage container is mounted on the image forming apparatus.

The method of Item 4 is the two component developer filling method described in any one of Items 1 to 3, and is characterized in that the filling of the two component developer into the developer storage container conducts filling of toner and carrier into the developer storage container on the condition that magnets are made existence, and includes at least a process of arranging magnets along the outer periphery of the developer storage container; a process of filling carrier in the developer storage container on the condition that the magnets are arranged; and a process of filling toner in the developer storage container on the condition that the magnets are arranged.

The method of Item 5 is the two component developer filling method described in Items 4, and is characterized in that in the process of filling toner in the developer storage container on the condition that the magnets are arranged, the toner is filled in the developer storage container in which the carrier is filled up.

The method of Item 6 is the two component developer filling method described in any one of Items 1 to 3, and is characterized in that the filling of the two component developer into the developer storage container includes at least a process of filling the two component developer in the developing storage container shaped in a cylindrical form so as to form the toner region and the carrier region; a process of arranging magnets at positions, where the carrier regions exists, among the outer periphery of the developer storage container; a process of rotating the developing storage container in which the two component developer is filled up, and shifting the magnets along the lengthwise direction of the rotating cylindrical developing storage container.

The method of Item 7 is the two component developer filling method described in Item 1 or 2, and is characterized in that the developer storage container feeds the stored two component developer to a developing device constituting an image forming apparatus on the condition that the developer storage container is mounted on the image forming apparatus, and the two component developer is filled so as to form the toner region and the carrier region in perpendicular to the conveyance direction of the two component developer caused in the developer storage container when the two component developer is fed to the developing device on the condition that the developer storage container is mounted on the image forming apparatus.

The method of Item 8 is the two component developer filling method described in Item 8, and is characterized in that the two component developer is filled in the developer storage container by conducting alternately filling of toner and filling of carrier.

The product of Item 9 is a two component developer storage product in which a two component developer containing at least toner and carrier is filled in a developer storage container, and is characterized in that in the two component developer storage product, the two component developer is filled in the developer storage container by use of the two component developer filling method described in any one of Items 1 to 8, and the two component developer stored in the developer storage container forms a state of stacked layers separated into a toner region and a carrier region.

In this connection, the "two component developer storage product" means a product in which a two component developer composed of at least toner and carrier is filled in a container called a developer storage container as shown in FIG. 1, for example, so that the product is made in a configuration capable of being actually distributed in a commercial market. Namely, the product has the configuration that the stored develop is not likely to be influenced by external environmental factors such as moisture, that allows a producer to provide quality certificate for an arbitrary period, and that can serve in commodity distribution by use of well-known transportation facilities and warehouse. Moreover, the product has the configuration that when a user mounts the container, as it is, on an image forming apparatus, the container, as it is, can feed the stored developer to the image forming apparatus.

The product of Item 10 is the two component developer storage product described in Item 9, and is characterized in that in a developing storage container constituting the two component developer storage product, a section to store the two component developer has a cylindrical form.

The product of Item 11 is the two component developer storage product described in Item 9 or 10, and is characterized in that in the two component developer storage product, a container main body constituting the developing storage container is configured to be rotated and to convey the two component developer stored in the container main body by the rotation so as to feed the two component developer to the image forming apparatus.

The product of Item 12 is the two component developer storage product described in any one of Items 9 to 11, and is characterized in that a carrier concentration in the two component developer stored in the two component developer storage product is 5% by weight or more and 30% by weight or less.

The product of Item 13 is the two component developer storage product described in any one of Items 9 to 12, and is characterized in that a state of stacked layers formed by the two component developer stored in the two component developer storage product is formed in parallel to the conveyance direction of the two component developer caused in the two component developer storage product when the two component developer is fed to a developing device constituting an image forming apparatus on the condition that two component developer storage product is mounted on the image forming apparatus.

The product of Item 14 is the two component developer storage product described in any one of Items 9 to 13, and is characterized in that in the state of stacked layers formed by the two component developer stored in the two component developer storage product, the carrier region is shaped in the form of spiral.

The product of Item 15 is the two component developer storage product described in any one of Items 9 to 12, and is characterized in that a state of stacked layers formed by the two component developer stored in the two component developer storage product is formed in perpendicular to the conveyance direction of the two component developer caused in the two component developer storage product when the two component developer is fed to a developing device constituting an image forming apparatus on the condition that two component developer storage product is mounted on the image forming apparatus.

In the present invention, when a two component developer for replenishment is filled in a developer storage container, toner and carrier are filled so as to form a state of stacked layers so that the toner and carrier stored in the container can be preserved in the separated state until the toner and carrier are fed to a developing device. As a result, the contact between toner and carrier can be suppressed to the minimum, and the reduction of an electric charge amount of a replenishment developer due to deterioration and the occurrence of spent toner can be suppressed, whereby toner can be electrically charged stably to a predetermined level at the time of image formation.

Further, filling of toner and carrier in the state of stacked layer makes it possible to store a two component developer in a developer storage container with a high filling rate, and also makes it possible to eliminate dispersion in carrier concentration in the container.

In this way, in the present invention, a two component developer is filled in the state of stacked layers composed of a toner layer (toner region) and a carrier layer (carrier region). Accordingly, the quality of a two component developer for replenishment can be maintained stably immediately before the two component developer is fed to a developing device. Namely, toner and carrier are preserved separately immediately before toner and carrier are fed to a developing device, and when the toner and carrier are fed to the developing device, the toner and carrier are first mixed uniformly. Therefore, the charge providing performance with the predetermined level can be maintained over a long period of time in the developing device. As a result, print formation with a predetermined image quality can conducted stably over a long period of time.

Further, since the charge providing performance with the predetermined level can be maintained over a long period of time in the developing device, the deterioration of the two component developer in the developing device can be suppressed, and the fed developer can be used for image formation without waste so as to contribute effective use of resource from the side face. Especially, the present invention is preferable in providing a replenishment developer for an image forming apparatus employing the "auto refining development method" which feeds new carrier together with toner, which is consumed for image formation, to the image forming apparatus so as to maintain the quality of the developer used for image formation.

Furthermore, since the filling technique so as to form the state of stacked layer of a toner layer and a carrier layer allows a two component developer to be filled with a high filling rate, a merit capable of filling a large amount of the developer in a developer storage container can be obtained. Concretely, the number of times of delivery of developer storage products can be reduced so that the cost and energy consumption in terms of commodity distribution can be reduced also. In addition, the filling technique of the present invention can contribute to reduce print cost and energy consumption per one page at the user side.

Moreover, at the time of filling of a two component developer, the two component developer can be filled in a container with a high filling rate without receiving large load. It is considered that this fact contributes to stabilize the charge providing performance of the developer in the developing device for a long period of time.

What is claimed is:

1. A two component developer storage product to replenish a two component developer containing at least toner and carrier, comprising:

a cylindrical container having an opening at one end thereof;

a lid to close the opening;

a toner layer stored in the cylindrical container; and a carrier layer stored in the cylindrical container;

wherein the toner layer and the carrier layer are stacked to form a stacked layer, and the cylindrical container has a spiral projection on an inner spherical surface thereof, and is configured such that when the cylindrical container is rotated, the toner layer and the carrier layer are conveyed by the spiral projection and toner and carrier are discharged from the opening.

2. The two component developer storage product described in claim 1, wherein a toner content in the toner layer is 95% by weight or more, and a carrier content in the carrier layer is 95% by weight or more.

3. The two component developer storage product described in claim 1, wherein the toner layer and the carrier layer are arranged in parallel to the conveyance direction respectively.

4. The two component developer storage product described in claim 1, wherein the toner layer and the carrier layer are arranged in perpendicular to the conveyance direction respectively.

5. The two component developer storage product described in claim 1, wherein the toner layer and the carrier layer are arranged such that a carrier content in the total amount of the toner and the carrier discharged from the opening is 5% by weight or more and 30% by weight or less.

6. The two component developer storage product described in claim 1, wherein the lid has a feeding port through which the toner and the carrier discharged from the opening are fed in a predetermined direction.

* * * * *